US011834838B2

(12) United States Patent
Hoffberg et al.

(10) Patent No.: US 11,834,838 B2
(45) Date of Patent: Dec. 5, 2023

(54) WHEELCHAIR RAMP

(71) Applicants: Richard Hoffberg, West Harrison, NY (US); Nicholas Peterson, Crystal Lake, NY (US); Matthew Swain, Buffalo, NY (US); Paula Zubiri, Tustin, CA (US); Berk Alper, Pittsburgh, PA (US); Ashwini Ganpule, Templeton, CA (US)

(72) Inventors: Richard Hoffberg, West Harrison, NY (US); Nicholas Peterson, Crystal Lake, NY (US); Matthew Swain, Buffalo, NY (US); Paula Zubiri, Tustin, CA (US); Berk Alper, Pittsburgh, PA (US); Ashwini Ganpule, Templeton, CA (US)

( * ) Notice: Subject to any disclaimer, the term of this patent is extended or adjusted under 35 U.S.C. 154(b) by 856 days.

(21) Appl. No.: 16/868,501

(22) Filed: May 6, 2020

(65) Prior Publication Data

US 2020/0354963 A1 Nov. 12, 2020

Related U.S. Application Data

(60) Provisional application No. 62/849,111, filed on May 16, 2019, provisional application No. 62/844,114, filed on May 6, 2019.

(51) Int. Cl.

| | |
|---|---|
| ***E04F 11/00*** | (2006.01) |
| ***A61G 5/06*** | (2006.01) |
| ***A61G 5/10*** | (2006.01) |

(52) U.S. Cl.

CPC ..... *E04F 11/002* (2013.01); *A61G 5/061* (2013.01); *A61G 5/10* (2013.01); *E04F 2011/005* (2013.01)

(58) Field of Classification Search

CPC .. E04F 11/002; E04F 2011/005; A61G 5/061; A61G 5/10; A61G 5/06

(Continued)

(56) References Cited

U.S. PATENT DOCUMENTS 3,231,290 A * 1/1966 Weyer ..... A61G 5/061 280/5.22
3,640,566 A * 2/1972 Hodge ..... A61G 5/006 5/81.1 R (Continued)

FOREIGN PATENT DOCUMENTS

CN 105726232 A * 7/2016
DE 3913079 A1 * 10/1990

(Continued)

*Primary Examiner* — Minnah L Seoh
*Assistant Examiner* — Ryan Edward Hardy
(74) *Attorney, Agent, or Firm* — Hoffberg & Associates; Steven M. Hoffberg

(57) ABSTRACT

A ramp transportation system for a wheelchair enables transportation, deployment, and retrieval of a portable ramp by a single wheelchair occupant in the absence of external aid. The device comprises: a platform, configured to support the width of a wheelchair for crossing the platform, having a sufficient stiffness to support a wheelchair and occupant load; a lifting mechanism interface in the platform, disposed at least near each end of the ramp, configured to support cantilever lifting forces on the ramp; a lifting element, configured to engage the lifting mechanism interface and to apply a force to raise and lower the platform between a raised, stowed position and a lowered position, suitable for traversal; and a motor, configured to supply sufficient force on the lifting element to raise and lower the platform.

20 Claims, 18 Drawing Sheets

(58) Field of Classification Search
USPC ..... 280/5.2, 5.24, DIG. 10, 304.1
See application file for complete search history.

(56) References Cited

U.S. PATENT DOCUMENTS 4,039,096 A 8/1977 McAllister
4,084,713 A 4/1978 Rohrs et al.
4,126,197 A 11/1978 Kechely
4,219,104 A 8/1980 MacLeod
4,339,224 A 7/1982 Lamb
4,368,553 A 1/1983 Perry
4,368,898 A 1/1983 Lay
4,441,710 A 4/1984 Lay
4,461,609 A 7/1984 Zinno
4,559,659 A 12/1985 Hunter, Jr.
4,580,652 A 4/1986 Turner et al.
4,630,709 A 12/1986 Taylor
4,726,516 A 2/1988 Cree
4,741,660 A 5/1988 Kent
4,765,614 A 8/1988 Shute
4,805,202 A 2/1989 Deucher et al.
4,807,317 A 2/1989 Quinn et al.
4,865,312 A 9/1989 Katz
4,911,425 A 3/1990 Kynast et al.
4,912,796 A 4/1990 Crump
4,966,362 A * 10/1990 Ramaekers ..... A63B 71/0009 482/148
4,966,516 A 10/1990 Vartanian
5,040,936 A 8/1991 Rhea
5,062,174 A 11/1991 DaSalvo
5,085,555 A 2/1992 Vartanian
5,106,152 A 4/1992 Ward, Sr. et al.
5,137,114 A 8/1992 Yde et al.
5,160,236 A 11/1992 Redding et al.
5,182,056 A 1/1993 Spence et al.
5,199,231 A 4/1993 Dever
5,230,522 A * 7/1993 Gehlsen ..... A61G 3/063 D34/24
5,259,081 A 11/1993 Henderson
5,325,558 A 7/1994 Labreche
5,380,144 A 1/1995 Smith et al.
5,391,041 A 2/1995 Stanbury et al.
5,439,342 A 8/1995 Hall et al.
5,454,196 A 10/1995 Gaines et al.
5,476,429 A 12/1995 Bigelow et al.
5,505,663 A 4/1996 Goulart et al.
5,562,272 A 10/1996 McAbee et al.
5,636,399 A 6/1997 Tremblay et al.
5,652,976 A 8/1997 Hopper
5,676,515 A 10/1997 Haustein
5,704,876 A 1/1998 Baatz
5,709,631 A 1/1998 Kleinsasser
5,807,185 A 9/1998 Raubuck et al.
5,815,870 A 10/1998 Deutch et al.
5,832,555 A 11/1998 Saucier et al.
5,871,329 A 2/1999 Tidrick et al.
5,901,395 A 5/1999 Vander Heiden et al.
5,933,898 A 8/1999 Estes et al.
5,935,011 A 8/1999 Morgan et al.
5,994,649 A 11/1999 Garfinkle et al.
6,004,233 A 12/1999 Raubuck et al.
6,009,586 A 1/2000 Hawkes et al.
6,082,957 A 7/2000 Kupka, Jr.
6,175,982 B1 1/2001 Cushwa
6,179,076 B1 1/2001 Fernie et al.
6,179,545 B1 1/2001 Petersen, Jr. et al.
6,227,790 B1 5/2001 Mollick et al.
6,264,416 B1 7/2001 Eaton, Jr.
6,340,280 B1 1/2002 Mollick et al.
6,343,908 B1 * 2/2002 Oudsten ..... A61G 3/061 414/921
6,390,537 B1 5/2002 DiGonis
6,430,769 B1 8/2002 Allen
6,463,613 B1 10/2002 Thompson
6,475,096 B2 11/2002 Nickolai
6,481,036 B1 11/2002 Duvall
6,526,614 B2 3/2003 Anderson et al.
6,602,041 B2 8/2003 Lewis et al.
6,616,396 B2 9/2003 Sternberg
6,698,998 B2 3/2004 Koretsky
6,736,732 B1 5/2004 Devine
D494,336 S 8/2004 Smith
D494,726 S 8/2004 Smith
6,825,628 B2 11/2004 Heigl et al.
6,843,635 B2 1/2005 Cohn
6,860,701 B2 3/2005 Kiser
6,928,959 B1 8/2005 Trauernicht et al.
6,951,435 B1 10/2005 Fennessy, Sr.
6,957,716 B1 10/2005 Norris
6,986,519 B2 1/2006 Smith
6,997,815 B2 2/2006 Devine
7,001,132 B2 2/2006 Koretsky et al.
7,033,127 B2 4/2006 Ungetheim et al.
7,040,248 B1 5/2006 Whitfield
7,052,227 B2 5/2006 Navarro
7,240,388 B2 7/2007 Warford
7,243,938 B2 7/2007 Stamps et al.
7,264,433 B2 9/2007 Navarro
7,309,836 B2 12/2007 Lubanski
7,326,024 B2 2/2008 Cohn et al.
7,385,139 B2 6/2008 Lubanski
7,533,432 B2 5/2009 Morris et al.
7,533,433 B2 5/2009 Morris et al.
7,533,434 B2 5/2009 Morris et al.
7,559,400 B2 7/2009 Smith
7,592,547 B2 9/2009 Lubanski
D602,673 S 10/2009 Allen
7,604,572 B2 10/2009 Stanford
7,607,186 B1 10/2009 Mitchell
7,681,272 B2 3/2010 Morris et al.
7,758,475 B2 7/2010 Goldberg
7,798,761 B2 9/2010 Goodrich et al.
7,802,337 B2 9/2010 van Roosmalen et al.
7,837,203 B1 11/2010 Schmidt et al.
7,850,189 B2 12/2010 Barber et al.
7,870,630 B2 1/2011 Johnson
7,870,631 B2 1/2011 Morris et al.
7,913,341 B1 3/2011 Morris et al.
7,913,342 B1 3/2011 Morris et al.
7,913,343 B1 3/2011 Cohn
7,945,458 B1 5/2011 Jackson
7,946,083 B2 5/2011 Kirby
8,000,892 B2 8/2011 Banerjee
8,020,234 B2 9/2011 Johnson et al.
8,032,963 B2 10/2011 Morris et al.
8,057,152 B1 11/2011 White
8,087,496 B1 1/2012 Taylor
8,087,559 B2 1/2012 Medina et al.
8,122,552 B2 2/2012 Morris et al.
8,122,553 B1 2/2012 Johnson et al.
8,132,281 B1 3/2012 Johnson et al.
8,166,594 B1 5/2012 Morris
8,181,300 B1 5/2012 Johnson et al.
8,215,020 B1 7/2012 Johnson
8,230,539 B2 7/2012 Morris et al.
8,234,737 B2 8/2012 Morris et al.
8,240,053 B1 8/2012 Johnson
8,250,693 B1 8/2012 Johnson et al.
8,307,473 B1 * 11/2012 Lambarth ..... A61G 5/061 5/81.1 R
8,327,485 B1 12/2012 Morris et al.
8,359,691 B2 1/2013 Morris et al.
8,375,496 B1 2/2013 Johnson et al.
8,398,356 B2 3/2013 Sandoz
8,402,660 B1 3/2013 Johnson et al.
8,434,181 B1 5/2013 Johnson et al.
8,438,683 B1 5/2013 Morris et al.
8,505,141 B1 8/2013 Morris et al.
8,533,884 B1 9/2013 Johnson et al.
8,534,979 B2 9/2013 Hansen
8,578,536 B1 11/2013 Morris
8,590,159 B1 11/2013 Johnson et al.
8,594,935 B2 11/2013 Cioffi et al.
8,621,696 B1 1/2014 Morris

(56) References Cited

U.S. PATENT DOCUMENTS 8,635,729 B1 1/2014 Johnson et al.
8,640,827 B2 2/2014 Breithaupt, Jr.
8,733,792 B2 5/2014 Wallace
8,739,341 B1 6/2014 Morris
8,745,800 B1 6/2014 Morris
8,763,186 B2 7/2014 Mosey et al.
8,769,823 B1 7/2014 Johnson et al.
8,813,289 B1 8/2014 Clark et al.
8,832,001 B2 9/2014 Handley
8,844,083 B2 9/2014 McGivern et al.
8,869,333 B2 10/2014 Johnson et al.
8,886,462 B1 11/2014 Cioffi et al.
8,919,049 B2 12/2014 Meserini
8,938,837 B1 1/2015 Johnson et al.
8,959,693 B2 2/2015 Pohlman et al.
8,979,162 B1 3/2015 Alasfour
8,989,348 B2 3/2015 Cox
8,994,776 B2 3/2015 Sutherland et al.
9,016,976 B2 4/2015 Dixon
D731,601 S 6/2015 Bradley et al.
9,050,229 B1 6/2015 Morris et al.
9,101,519 B2 8/2015 Smith et al.
9,109,908 B2 8/2015 Bach
9,114,049 B2 8/2015 Callahan
9,121,809 B2 9/2015 Cox et al.
9,271,883 B2 3/2016 Johnson et al.
9,289,337 B2 3/2016 Fritsche et al.
9,440,356 B2 9/2016 Sutherland et al.
9,498,696 B1 11/2016 Razon
9,513,385 B2 12/2016 Cox
9,574,885 B2 2/2017 Bach
9,632,671 B2 4/2017 Albright
9,659,503 B2 5/2017 Gordon et al.
9,689,811 B2 6/2017 Cox et al.
9,734,725 B2 8/2017 Gordon et al.
9,789,922 B2 10/2017 Dosenbach et al.
9,820,899 B1 11/2017 Morris et al.
9,863,776 B2 1/2018 Gordon et al.
9,896,871 B2 2/2018 Ungetheim et al.
10,010,461 B2 7/2018 Kitchin et al.
10,020,956 B2 7/2018 Alberth, Jr.
10,029,370 B2 7/2018 Sutherland et al.
10,059,383 B2 8/2018 Pelletier et al.
10,062,302 B2 8/2018 Chen
10,157,509 B2 12/2018 Dolan et al.
10,187,471 B2 1/2019 Alberth, Jr.
10,231,895 B2 3/2019 Girardini et al.
10,246,015 B2 4/2019 Reymann et al.
10,255,794 B1 4/2019 Merjanian et al.
2001/0048870 A1 12/2001 Lewis et al.
2002/0072425 A1 6/2002 Nickolai
2002/0081184 A1 6/2002 Sternberg
2002/0105170 A1 8/2002 Smith
2002/0110444 A1 8/2002 Navarro
2002/0144364 A1 10/2002 Anderson et al.
2002/0159871 A1 10/2002 Ungetheim et al.
2002/0197141 A1 12/2002 Cohn
2003/0007851 A1 1/2003 Heigl et al.
2003/0210976 A1 11/2003 Koretsky
2003/0215316 A1 11/2003 Burney et al.
2004/0013507 A1 1/2004 Kiser
2004/0034950 A1 2/2004 Massaro
2004/0096304 A1 5/2004 Lewis et al.
2004/0147216 A1 7/2004 Temple et al.
2004/0172775 A1 9/2004 Koretsky et al.
2004/0228713 A1 11/2004 Cohn et al.
2004/0249855 A1 12/2004 Detweiler et al.
2005/0015899 A1 1/2005 Jeruss
2005/0074318 A1 4/2005 Howard
2005/0101394 A1 5/2005 Devine
2005/0123380 A1 6/2005 Massaro
2005/0173888 A1 8/2005 Stamps et al.
2005/0215371 A1 9/2005 Navarro
2005/0263987 A1 12/2005 Smith
2006/0027619 A1 2/2006 Walther
2006/0088396 A1 4/2006 Thom
2006/0104773 A1 5/2006 Koretsky et al.
2006/0104775 A1 5/2006 Kasten et al.
2006/0146719 A1 7/2006 Sobek et al.
2006/0156492 A1 7/2006 Warford
2006/0245883 A1 11/2006 Fontaine et al.
2007/0059140 A1 3/2007 Kiser
2007/0086879 A1 4/2007 Goodrich et al.
2007/0095560 A1 5/2007 Lubanski
2007/0095561 A1 5/2007 Lubanski
2007/0131883 A1 6/2007 Goodrich et al.
2007/0173392 A1 7/2007 Stanford
2007/0241153 A1 10/2007 Medina et al.
2008/0093102 A1 4/2008 Lubanski
2008/0184500 A1 8/2008 Bettcher
2008/0184502 A1 8/2008 Roberts
2008/0187425 A1 8/2008 Morris et al.
2008/0271266 A1 11/2008 Johnson
2008/0271267 A1 11/2008 Morris et al.
2008/0271268 A1 11/2008 Johnson
2008/0271269 A1 11/2008 Morris et al.
2008/0273956 A1 11/2008 Morris et al.
2008/0312819 A1 12/2008 Banerjee
2009/0035111 A1 2/2009 Morris et al.
2009/0035112 A1 2/2009 Morris et al.
2009/0035113 A1 2/2009 Morris et al.
2009/0106918 A1 4/2009 Van Roosmalen et al.
2009/0108561 A1 4/2009 Barber et al.
2009/0156371 A1 6/2009 Goldberg
2009/0250895 A1 10/2009 Smith
2009/0271077 A1 10/2009 Goodrich et al.
2009/0271934 A1 11/2009 Morris et al.
2009/0300860 A1 12/2009 Campbell
2009/0308672 A1 12/2009 Soldatos
2010/0011520 A1 1/2010 Wollborg
2010/0066111 A1 3/2010 Fritsche et al.
2010/0117312 A1* 5/2010 Walkingshaw ..... A61G 5/066
305/15
2010/0241350 A1 9/2010 Cioffi et al.
2010/0307096 A1 12/2010 Kirby
2011/0008141 A1 1/2011 Goodrich et al.
2011/0023246 A1 2/2011 Morris et al.
2011/0027054 A1 2/2011 Hansen
2011/0035104 A1 2/2011 Smith
2011/0041418 A1 2/2011 Meserini
2011/0049828 A1 3/2011 Schmidt et al.
2011/0072598 A1 3/2011 Morris et al.
2011/0073824 A1 3/2011 Lappin et al.
2011/0088174 A1 4/2011 Morris et al.
2011/0088175 A1 4/2011 Morris et al.
2011/0088176 A1 4/2011 Cohn
2011/0088177 A1 4/2011 Johnson et al.
2011/0088179 A1 4/2011 Morris et al.
2011/0127402 A1* 6/2011 Callahan ..... A61G 5/1051
248/678
2011/0147094 A1 6/2011 Gerster
2011/0159465 A1 6/2011 Gutridge
2011/0187080 A1 8/2011 Wallace
2011/0238291 A1 9/2011 Bach
2011/0270654 A1 11/2011 Banerjee et al.
2011/0297483 A1 12/2011 Breithaupt, Jr.
2012/0023669 A1 2/2012 Graller et al.
2012/0087716 A1 4/2012 Morris et al.
2012/0111261 A1 5/2012 Schmitt et al.
2012/0139197 A1* 6/2012 Livingston ..... A61G 5/066
280/5.22
2012/0238921 A1 9/2012 Kuehne et al.
2012/0259544 A1 10/2012 Watson et al.
2012/0278985 A1 11/2012 Cornille
2012/0294699 A1 11/2012 Sandoz
2013/0026737 A1* 1/2013 Pizzi Spadoni ..... A61G 5/08
280/647
2013/0055511 A1 3/2013 McGivern et al.
2013/0121761 A1 5/2013 Dixon
2013/0136231 A1 5/2013 Cox et al.
2013/0174359 A1 7/2013 Morris et al.
2013/0198978 A1 8/2013 Pohlman et al.
2013/0202087 A1 8/2013 Cox
2013/0205257 A1 8/2013 Albright

(56) References Cited

U.S. PATENT DOCUMENTS

| | | | | |
|---|---|---|---|---|
| 2013/0232685 | A1 | 9/2013 | Cornille | |
| 2013/0330157 | A1 | 12/2013 | Asztalos et al. | |
| 2014/0009561 | A1 | 1/2014 | Sutherland et al. | |
| 2014/0035921 | A1 | 2/2014 | Yeh | |
| 2014/0039986 | A1 | 2/2014 | Handley | |
| 2014/0040166 | A1 | 2/2014 | Handley | |
| 2014/0123410 | A1 | 5/2014 | Mosey et al. | |
| 2014/0123411 | A1 | 5/2014 | Mosey et al. | |
| 2014/0199144 | A9 | 7/2014 | Asztalos et al. | |
| 2014/0219756 | A1 | 8/2014 | Smith et al. | |
| 2014/0245548 | A1 | 9/2014 | Johnson et al. | |
| 2014/0248109 | A1 | 9/2014 | Johnson et al. | |
| 2014/0324341 | A1 | 10/2014 | Cioffi et al. | |
| 2015/0032490 | A1 | 1/2015 | Handley | |
| 2015/0127256 | A1 | 5/2015 | Cioffi et al. | |
| 2015/0177391 | A1 | 6/2015 | Cox | |
| 2015/0190927 | A1 | 7/2015 | Sutherland et al. | |
| 2015/0330787 | A1 | 11/2015 | Cioffi et al. | |
| 2015/0345956 | A1 | 12/2015 | Bach | |
| 2015/0346118 | A1 | 12/2015 | Cox et al. | |
| 2016/0019473 | A1 | 1/2016 | Yadidi | |
| 2016/0095767 | A1 | 4/2016 | Smith et al. | |
| 2016/0104081 | A1 | 4/2016 | Ho et al. | |
| 2016/0164976 | A1 | 6/2016 | Hassan | |
| 2016/0176459 | A1 | 6/2016 | Dosenbach | |
| 2016/0220431 | A1 | 8/2016 | Asztalos et al. | |
| 2016/0221607 | A1 | 8/2016 | Schmidt | |
| 2016/0242975 | A1 | 8/2016 | Kitchin et al. | |
| 2016/0325585 | A1* | 11/2016 | Hays | B60L 3/00 |
| 2017/0015003 | A1 | 1/2017 | Sutherland et al. | |
| 2017/0016735 | A1 | 1/2017 | Gordon et al. | |
| 2017/0018193 | A1 | 1/2017 | Gordon et al. | |
| 2017/0038484 | A1 | 2/2017 | Cox | |
| 2017/0111453 | A1 | 4/2017 | Hassan | |
| 2017/0176194 | A1 | 6/2017 | Gordon et al. | |
| 2017/0234048 | A1 | 8/2017 | Ungetheim et al. | |
| 2017/0240214 | A1 | 8/2017 | Pelletier et al. | |
| 2017/0256181 | A1 | 9/2017 | Chen | |
| 2017/0325776 | A1 | 11/2017 | Cox et al. | |
| 2017/0347885 | A1 | 12/2017 | Tan et al. | |
| 2017/0350130 | A1 | 12/2017 | Meisel | |
| 2018/0086601 | A1 | 3/2018 | Okonski et al. | |
| 2018/0123821 | A1 | 5/2018 | Alberth, Jr. | |
| 2018/0124178 | A1 | 5/2018 | Alberth, Jr. | |
| 2018/0128031 | A1 | 5/2018 | Ungetheim et al. | |
| 2018/0139285 | A1 | 5/2018 | Hassan | |
| 2018/0174111 | A1 | 6/2018 | Breedvelt-Schouten et al. | |
| 2018/0174112 | A1 | 6/2018 | Breedvelt-Schouten et al. | |
| 2018/0177652 | A1* | 6/2018 | Furman | A61G 5/061 |
| 2018/0182181 | A1 | 6/2018 | Dolan et al. | |
| 2018/0185213 | A1* | 7/2018 | Naber | A61G 5/066 |
| 2018/0221236 | A1 | 8/2018 | Girardini et al. | |
| 2018/0300773 | A1 | 10/2018 | Oechsner | |
| 2018/0330586 | A1 | 11/2018 | Alberth, Jr. et al. | |
| 2018/0374003 | A1 | 12/2018 | Hou et al. | |
| 2019/0000699 | A1 | 1/2019 | Kitchin et al. | |
| 2019/0061619 | A1 | 2/2019 | Reymann et al. | |
| 2019/0070967 | A1 | 3/2019 | Ishigaki et al. | |
| 2019/0099315 | A1 | 4/2019 | Kuehne et al. | |
| 2019/0106042 | A1 | 4/2019 | Hill et al. | |
| 2019/0116228 | A1 | 4/2019 | Hassan | |
| 2020/0054508 | A1* | 2/2020 | Garland | A61G 5/066 |
| 2021/0196537 | A1* | 7/2021 | Schaberg | A61G 5/0891 |
| 2021/0196538 | A1* | 7/2021 | Pfeiffer | A61G 5/0833 |

FOREIGN PATENT DOCUMENTS

| | | | | | |
|---|---|---|---|---|---|
| EP | 2186496 | A1 | * | 5/2010 | A61G 5/10 |
| EP | 2838484 | B1 | * | 4/2016 | A61G 3/061 |
| GB | 2428649 | A | * | 2/2007 | A61G 5/061 |
| KR | 20030058806 | A | * | 7/2003 | |
| KR | 101235840 | B1 | * | 2/2013 | |
| KR | 101491070 | B1 | * | 2/2015 | |

* cited by examiner

1510

1520

1530

1540

1550

1560

1570

1580

WHEELCHAIR RAMP

CROSS REFERENCE TO RELATED APPLICATIONS

The present application claims benefit of priority under 35 U.S.C. § 119(e) from U.S. Provisional Patent Application No. 62/849,111, filed May 16, 2019, and from U.S. Provisional Patent Application No. 62/844,114, filed May 6, 2019, the entirety of which are expressly incorporated herein by reference.

FIELD OF THE INVENTION

The present invention relates to the field of self-transported wheelchair ramps.

BACKGROUND OF THE INVENTION

There are many public locations which are inaccessible to persons in wheelchairs. Usually this inaccessibility is caused by uneven surfaces such as steps, curbs, or gutters which cannot be readily traversed by a wheelchair when no ramp or curb cut are nearby to provide alternative access. The standard manual wheelchair is ineffective in overcoming these uneven surfaces without outside assistance or practice with special technique—namely "popping a wheelie." This "wheelie" technique, however, is not reliably nor safely performed by persons in wheelchairs lacking the necessary range of motion, strength, or balance, or even those persons with the physical capability to do so. What is required is a device for persons in wheelchairs which facilitates a safe transition across uneven surfaces without outside assistance.

Each reference cited herein is expressly incorporated herein by reference in its entirety. See U.S. Patents and Pub. Appln. Nos.: 4039096; 4084713; 4126197; 4219104; 4339224; 4368553; 4368898; 4441710; 4461609; 4559659; 4580652; 4630709; 4726516; 4741660; 4765614; 4805202; 4807317; 4865312; 4911425; 4912796; 4966516; 5040936; 5062174; 5085555; 5106152; 5137114; 5160236; 5182056; 5199231; 5259081; 5325558; 5380144; 5391041; 5439342; 5454196; 5476429; 5505663; 5562272; 5636399; 5652976; 5676515; 5704876; 5709631; 5807185; 5815870; 5832555; 5871329; 5901395; 5933898; 5935011; 5994649; 6004233; 6009586; 6082957; 6175982; 6179076; 6179545; 6227790; 6264416; 6340280; 6390537; 6430769; 6463613; 6475096; 6481036; 6526614; 6602041; 6616396; 6698998; 6736732; 6825628; 6843635; 6860701; 6928959; 6951435; 6957716; 6986519; 6997815; 7001132; 7033127; 7040248; 7052227; 7240388; 7243938; 7264433; 7309836; 7326024; 7385139; 7533432; 7533433; 7533434; 7559400; 7592547; 7604572; 7607186; 7681272; 7758475; 7798761; 7802337; 7837203; 7850189; 7870630; 7870631; 7913341; 7913342; 7913343; 7945458; 7946083; 8000892; 8020234; 8032963; 8057152; 8087496; 8087559; 8122552; 8122553; 8132281; 8166594; 8181300; 8215020; 8230539; 8234737; 8240053; 8250693; 8327485; 8359691; 8375496; 8398356; 8402660; 8434181; 8438683; 8505141; 8533884; 8534979; 8578536; 8590159; 8594935; 8621696; 8635729; 8640827; 8733792; 8739341; 8745800; 8763186; 8769823; 8813289; 8832001; 8844083; 8869333; 8886462; 8919049; 8938837; 8959693; 8979162; 8989348; 8994776; 9016976; 9050229; 9101519; 9109908; 9114049; 9121809; 9271883; 9289337; 9440356; 9498696; 9513385; 9574885; 9632671; 9659503; 9689811; 9734725; 9789922; 9820899; 9863776; 9896871; D494336; D494726; D602673; D731601; 10010461; 10020956; 10029370; 10059383; 10062302; 10157509; 10187471;

10231895; 10246015; 10255794; 20010048870; 20020072425; 20020081184; 20020105170; 20020110444; 20020144364; 20020159871; 20020197141; 20030007851; 20030210976; 20030215316; 20040013507; 20040034950; 20040096304; 20040147216; 20040172775; 20040228713; 20040249855; 20050015899; 20050074318; 20050101394; 20050123380; 20050173888; 20050215371; 20050263987; 20060027619; 20060088396; 20060104773; 20060104775; 20060146719; 20060156492; 20060245883; 20070059140; 20070086879; 20070095560; 20070095561; 20070131883; 20070173392; 20070241153; 20080093102; 20080184500; 20080184502; 20080187425; 20080271266; 20080271267; 20080271268; 20080271269; 20080273956; 20080312819; 20090035111; 20090035112; 20090035113; 20090106918; 20090108561; 20090156371; 20090250895; 20090271077; 20090271934; 20090300860; 20090308672; 20100011520; 20100066111; 20100241350; 20100307096; 20110008141; 20110023246; 20110027054; 20110035104; 20110041418; 20110049828; 20110072598; 20110073824; 20110088174; 20110088175; 20110088176; 20110088177; 20110088179; 20110127402; 20110147094; 20110159465; 20110187080; 20110238291; 20110270654; 20110297483; 20120023669; 20120087716; 20120111261; 20120238921; 20120259544; 20120278985; 20120294699; 20130055511; 20130121761; 20130136231; 20130174359; 20130198978; 20130202087; 20130205257; 20130232685; 20130330157; 20140009561; 20140035921; 20140039986; 20140040166; 20140123410; 20140123411; 20140199144; 20140219756; 20140245548; 20140248109; 20140324341; 20150032490; 20150127256; 20150177391; 20150190927; 20150330787; 20150345956; 20150346118; 20160019473; 20160095767; 20160104081; 20160164976; 20160176459; 20160220431; 20160221607; 20160242975; 20170015003; 20170016735; 20170018193; 20170038484; 20170111453; 20170176194; 20170234048; 20170240214; 20170256181; 20170325776; 20170347885; 20170350130; 20180086601; 20180123821; 20180124178; 20180128031; 20180139285; 20180174111; 20180174112; 20180182181; 20180221236; 20180300773; 20180330586; 20180374003; 20190000699; 20190061619; 20190070967; 20190099315; 20190106042; and 20190116228.

SUMMARY OF THE INVENTION

The present technology provides a self-portable wheelchair ramp that is supported behind the wheelchair in a near vertical position, and is lowered across an uneven surface by a motor-driven mechanism. Once in place, the ramp is free from the wheelchair, and the wheelchair is able to cross the surface. Once across, the ramp is then loaded on the back of the wheelchair using the same motor and mechanism. As result of the crossing, the ramp becomes inverted with respect to the user, and thus is symmetric. In general, the wheelchair is backed over the ramp after deployment, and then the chair turned around, with a visual guidance system, e.g., a camera and display, provided to permit efficient maneuvering of the chair to align with the ramp so it can be stowed for subsequent use.

A self-engaging "H-bar" links the wheelchair ramp to the lifting mechanism, which then releases the ramp to its deployed (near horizontal) position.

The motor acts through a cable and pulley system, to absorb shocks, and increase effective torque.

A mechanical safety latch secures the ramp in its near vertical position to prevent displacement of the ramp while not in use or in the event of system failure.

A mechanical stop protects the user and limits the range of motion of the ramp in stowage.

It is therefore an object to provide a ramp transportation system for a wheelchair, comprising: a platform assembly, configured to support the width of a wheelchair for crossing the platform assembly, having a sufficient stiffness to support a wheelchair and occupant load; a lifting mechanism interface in the platform assembly, disposed at least near each end of the ramp, configured to support cantilever lifting forces on the ramp; a lifting element, configured to engage the lifting mechanism interface and to apply a force to raise and lower the platform assembly between a raised, stowed position and a lowered position, suitable for traversal; a motor-driven mechanism, configured to supply sufficient force on the lifting element to raise and lower the platform assembly; a control, configured to drive the motor; A motor may be disposed below a seat of the wheelchair, and the platform assembly in the stowed position is behind the wheelchair. The platform assembly may be collapsible to accommodate wheelchair folding. The motor alone may directly drive the lifting element. The motor may drive a mechanism comprising a cable and a pulley. The motor may drive a mechanism comprising a geartrain. A mechanical or electromechanical safety may be provided to secure the platform assembly in the stowed position. A mechanical stop may be provided to prevent collision of the ramp with the rear of the wheelchair.

It is also an object to provide a wheelchair ramp system, comprising: a ramp having a platform, configured to support wheels of a wheelchair for traversing the platform, having a sufficient stiffness to support a wheelchair and occupant load, and a lifting mechanism interface in the platform disposed at least near each end of the platform, configured to support cantilever lifting forces on the platform; a lifting element, configured to engage the lifting mechanism interface and to apply a force to raise and lower the platform between a raised, stowed position and a lowered position, deployed position, suitable for traversal of the wheelchair across the platform; a motor, configured to supply sufficient force on the lifting element to raise and lower the platform; and a control, configured to drive the motor;

A motor may be disposed below a seat of the wheelchair. The platform or ramp in the stowed position may be disposed behind the wheelchair. The platform may be collapsible to accommodate wheelchair folding.

The motor alone may directly drive the lifting element. The motor may drive a mechanism comprising a cable and a pulley. The motor may drive a mechanism comprising a geartrain.

A mechanical element or electromechanical element may be provided to secure the platform in the stowed position. The mechanical element or electromechanical element may be manually or automatically operated to secure the platform in the stowed position.

A mechanical stop may be provided to prevent collision of the ramp with the rear of the wheelchair at the end of movement into the stowed position.

It is also an object to provide a method of permitting a wheelchair to traverse a sharp change in elevation, comprising: providing a ramp, configured to support wheels of the wheelchair for traversing the ramp, having a sufficient stiffness to support a wheelchair and occupant load, in a near vertical orientation at a rear of the wheelchair, the ramp having a lifting mechanism interface disposed at least near each end of the ramp, configured to support cantilever lifting forces on the ramp to raise and lower the ramp to and from a horizontal orientation, and to engage and disengage with a lifting mechanism; lowering the ramp at the rear of the wheelchair to a near horizontal orientation across the sharp change in elevation, by actuating the lifting mechanism to lower the ramp; and disengaging the lifting mechanism from the lifting mechanism interface, to thereby permit the wheelchair to freely traverse the ramp.

After the wheelchair traverses the ramp, the lifting mechanism may be reengaged with the lifting mechanism interface, and the ramp raised at the rear of the wheelchair from the near-horizontal orientation to the near vertical orientation.

The ramp may be latched at the rear of the wheelchair in the near vertical orientation.

The lowering and/or raising may be controlled by a microprocessor. The microprocessor may control additional features of the wheelchair, such as battery charging, obstacle avoidance, communications (cellular [WAN], WiFi [LAN], Bluetooth [PAN]), entertainment, guidance, navigation, autonomous features, and the like.

The lifting mechanism may be driven by a motor, configured to supply sufficient force on the lifting element to raise and lower the ramp. Alternately, a pneumatic or hydraulic system may be provided. For example, a pneumatic system may operate a cylinder from a compressed gas canister, which may be a sufficient reservoir for extended use, or recharged with a compressor. In this case, the compressor may be relatively small, since the recharge of the reservoir can occur over a much longer period that the traversal.

The motor, or other actuator system, may be controlled by a microprocessor. The motor may directly drive the ramp, drive the ramp through a cable and a pulley, drive the ramp through a geartrain, or other mechanism.

The method may comprise maintaining the ramp in the near vertical orientation with a latch, and unlatching the ramp before lowering the ramp. The latch may be manual or automated, and an automated latch may be driven by a microcontroller, and automatically unlatched before lowering the ramp. The ramp may be distanced from the rear of the wheelchair with a mechanical stop, which may have shock absorption capability to avoid dynamic disturbance of the wheelchair as the ramp is raised to the stowed position.

DETAILED DESCRIPTION OF THE PREFERRED EMBODIMENT

Full System Assembly Overview

The device is capable of deploying and retrieving a portable ramp, within a full user-cycle averaging no more than 1 minute 30 seconds (90 seconds). Furthermore, the device preferably is able to mount onto any standard wheelchair frame, and not interfere with normal use of the chair, including minimizing the weight of the addition.

Figure 1:
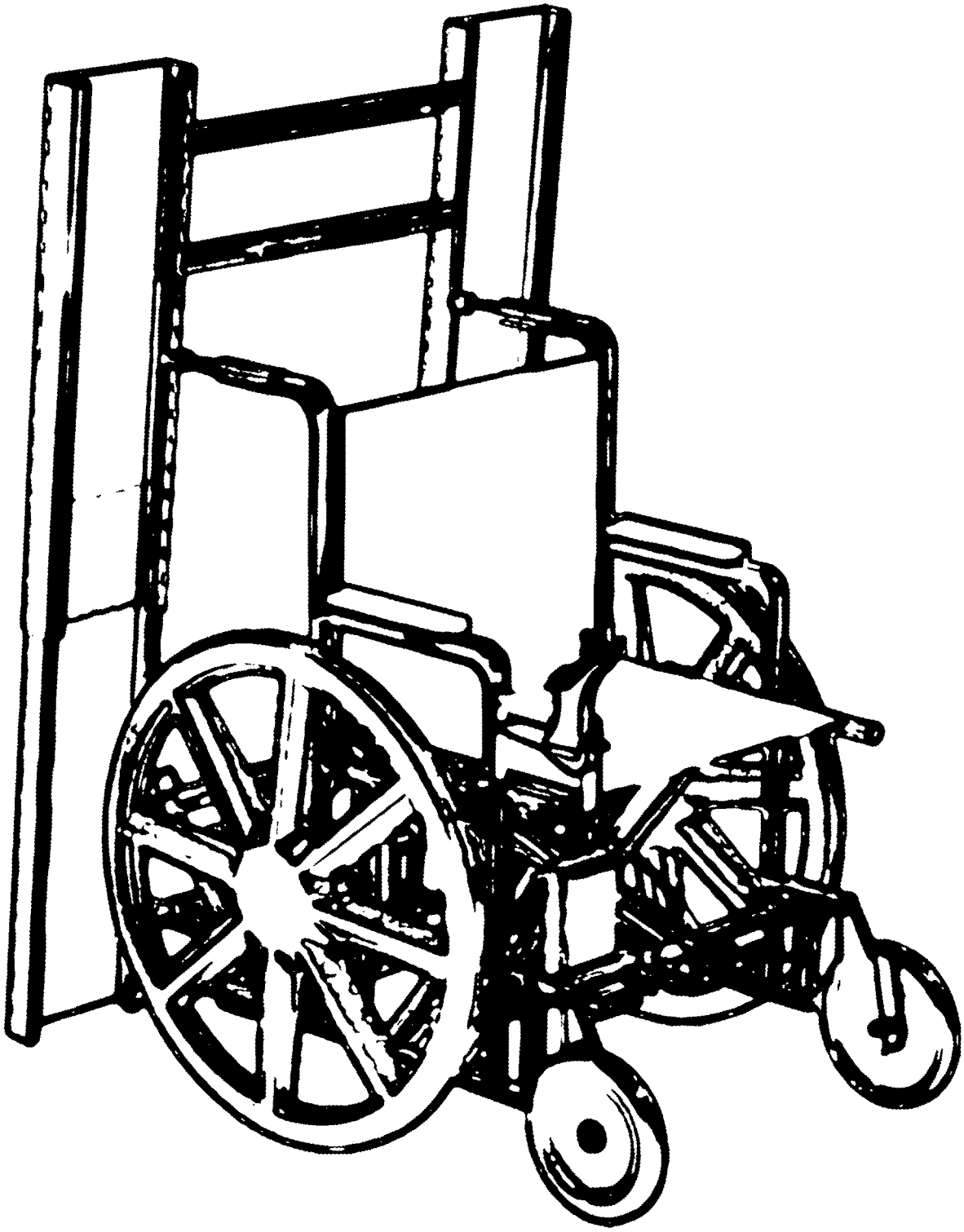
FIG. 1 shows a view of a full assembly with the ramp in stowed position.
Figure 2:
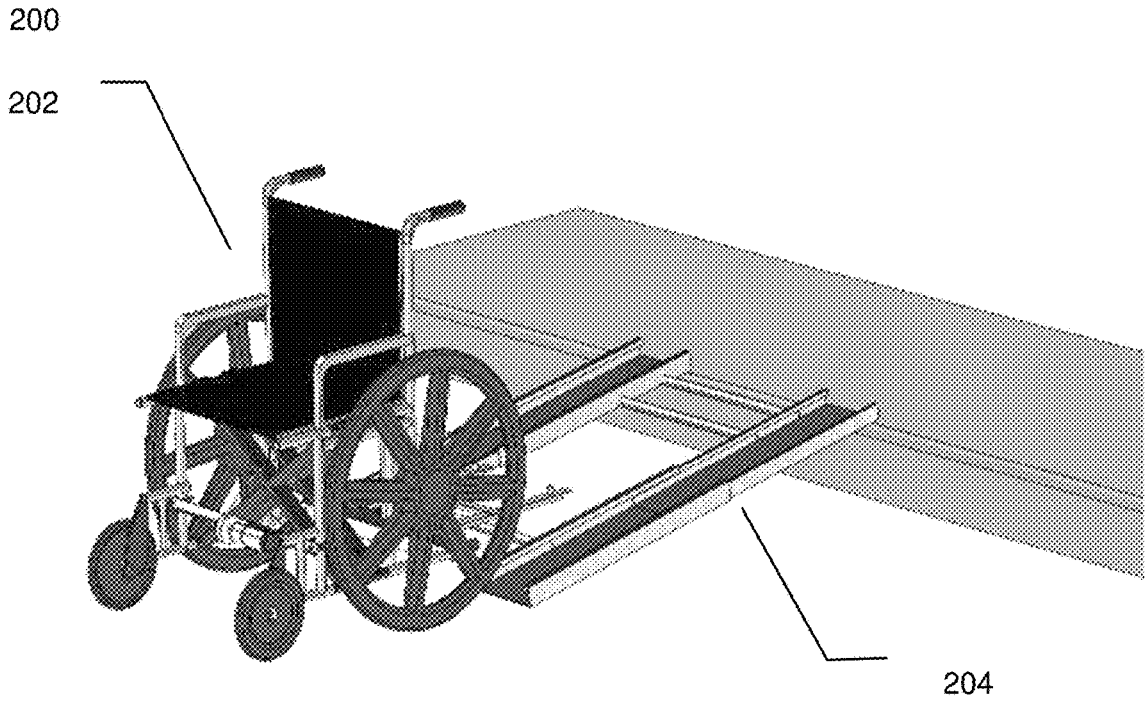
FIG. 2 shows the ramp lowered and deployed across a 7-inch curb.
Figure 3:
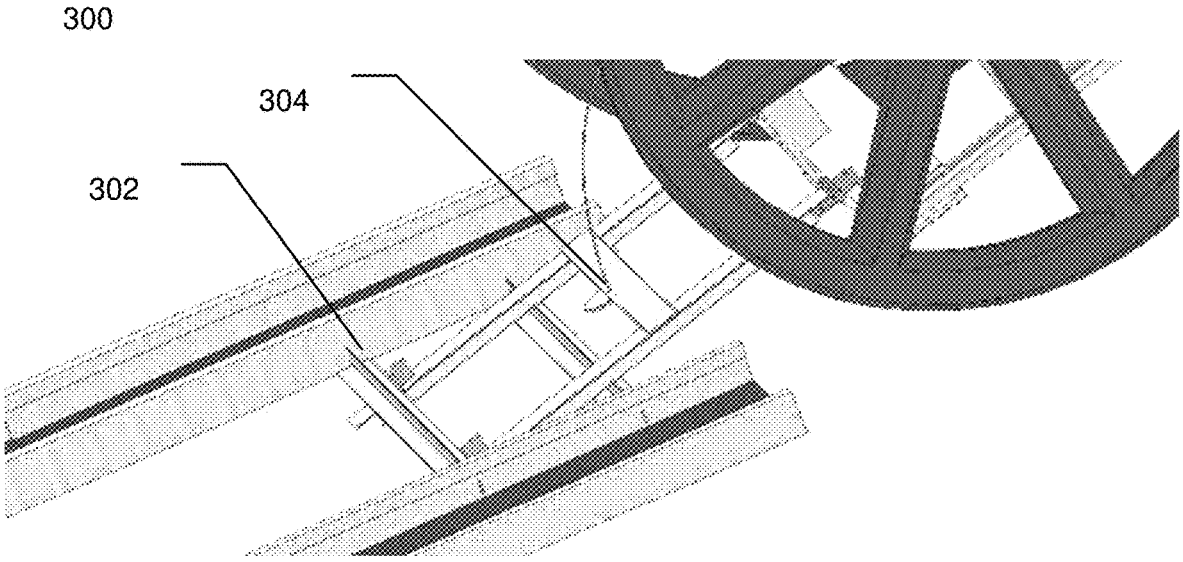
FIGS. 3-7 show views of the RAM which interfaces with the ramp.

FIG. 1 shows a model of the full device assembly mounted on a model wheelchair. FIG. 2 shows the ramp 202 lowered and deployed atop model 7-inch curb 204. The device consists of three major subsystems and mounting components to secure these systems to the wheelchair. These three major systems are:

the Ramp-Arm Mechanism ("RAM") 304; the Ramp System 302; and the Electromechanical System consisting of the motor/pulley, battery, microcontroller, and various other electrical components 1000.

The device functionally lowers and raises a hinged, rack-like, "H-bar" 304 arm on the rear of the wheelchair, which is referred to as the Ramp-Arm Mechanism ("RAM"). This lowering/raising function is accomplished by motor-torque supplied from the Electromechanical System: torque is transferred by a steel cable 402 channeled from the motor/pulley at the front of the wheelchair to the RAM at the rear of the chair. In the stowed state, towards the very rear of the wheelchair and resting on the RAM is the Ramp System. This ramp-set consists of two pre-manufactured ramp-rails 404, each 7.5 inches in width and fixed to a length of 4-feet for normal usage. Of course, the length may vary, and the width should correspond to the width of the wheelchair itself.

Components/Subsystems

T-Beams 502 and L-Beams 602 were used for many of the structural components of the system, in order to increase structural strength against bending stress.

A reducing pulley system is used in order to reduce the amount of torque required from the motor, and thus double the maximum lift force the motor could provide to the RAM. While this may be avoided by use of a powerful motor alone, this reduction increases the device factor of safety to account for unforeseen sources of friction, such as dirt or debris in the hinged element, reduces peak power and current, and weight of the motor and battery.

A free-rotating hinge with more than 180 degrees of rotation 702, is used to allow the RAM H-Bar to freely pivot. This range of motion may also be accomplished by use of other connectors, such as a set of ball and socket joints, however simple hinges proved to be sufficient in the embodiment.

Springs and spring-loaded rods were used in locations to induce a tendency in components (i.e., the Ramp and RAM) to move in the deployment direction when released (not shown).

Shaft Collars 1200 provide a reliable point of connection for the system components onto the wheelchair's frame, without adding too much weight or damaging the wheelchair.

The user interfaces with three switches 1802:

Rocker—to turn the system on and off.

Toggle—to change the direction of the RAM (up/down).

Push—to activate the RAM to raise or lower the ramp.

A microcontroller 1804 (e.g., an Arduino, powered by a 9V battery) reads these switch inputs and then sends a pulse width modulated ("PWM") signal to the motor controller. The motor controller then supplies power from the main battery 1806 to the motor 1808 to drive it in the desired direction. The motor, as a result, then provides sufficient torque 1810 to raise and lower 1812 the ramp 1814. The microcontroller and associated circuitry may be provided with various sensors, such as current, voltage, motor speed, motor temperature, battery state, etc., which may provide ancillary basis for control over the system. The motor and motor controller are both powered by a rechargeable 20V battery.

When ascending, the ramp will automatically stop when vertical. A limit switch 1604 is triggered in order to stop the system for safety reasons. Of course, other ramp-state sensors may be provided and used for control.

Ramp-Arm Mechanism (RAM)

The RAM consists of one pair of 17-inch aluminum T-beams 502 attached and hinged to a crossbeam 604 spanning the width between two cylindrical members at the rear of the wheelchair. The T-beams are fixed in width by another ~11-inch aluminum T-beam 606 member located about 6.5 inches along their length from the hinges. Steel cable 402 is channeled through this horizontal T-beam member 802 and ends at a disk-shaped stopper behind the beam 804. A ~6.5-inch tall vertical aluminum post 806 and mounted pulley 808 (shown in FIG. 8) also channel this steel cable and provides mechanical advantage in applying torque to the ramp. Upright tabs 608 are affixed at the end of the RAM and serve to indicate when the user has touched the second horizontal beam of the ramp during retrieval.

As the RAM is hinged, it may rotate to be nearly upright when in rest 1100. Due to the set length of the steel cable, the RAM may also rotate about 40° below the wheelchair's horizontal 1560. This range of motion is utilized in lowering/deploying the ramp, and again during lifting/retrieval of the ramp.

FIGS. 3-7 show various views of the RAM as it is intended to interface with the Ramp System during retrieval—when the user has rolled their wheelchair up and onto a raised curb, the RAM has been lowered, and the user has reversed until the RAM's far tabs have touched the second horizontal beam of the ramp. In this process, the RAM slides over the first horizontal beam of the ramp and slides just under the second horizontal beam. The motor then drives the steel cable to pull the RAM/Ramp combination toward the rear-face of the chair to its intended rest position.

Ramp System

The Ramp System consists of two pre-manufactured aluminum telescoping ramp-rails 404, each 7.5 inches in width and fixed to a length of 4-feet during use. For storage purposes, the user may still telescope the ramp-set down to just under 3-feet by depressing the buttons on both sides 704. The Ramp system is fixed to a width of 31 inches by four horizontal beams, accommodating the distance between the wheelchair rear-wheels as well as the distance between the wheelchair casters. These horizontal beams slide into slots machined into the side of the ramp and are secured by screw. The layout of these four beams ensures a symmetrical user cycle in which the RAM can interface at the top or bottom of a curb.

The ramp itself is rated for 600-lbs load, and includes a high traction grit surface as well as sidewalls to prevent the user from falling off the sides.

FIG. 2 shows the ramp deployed onto a 7-inch high curb.

Figure 4:
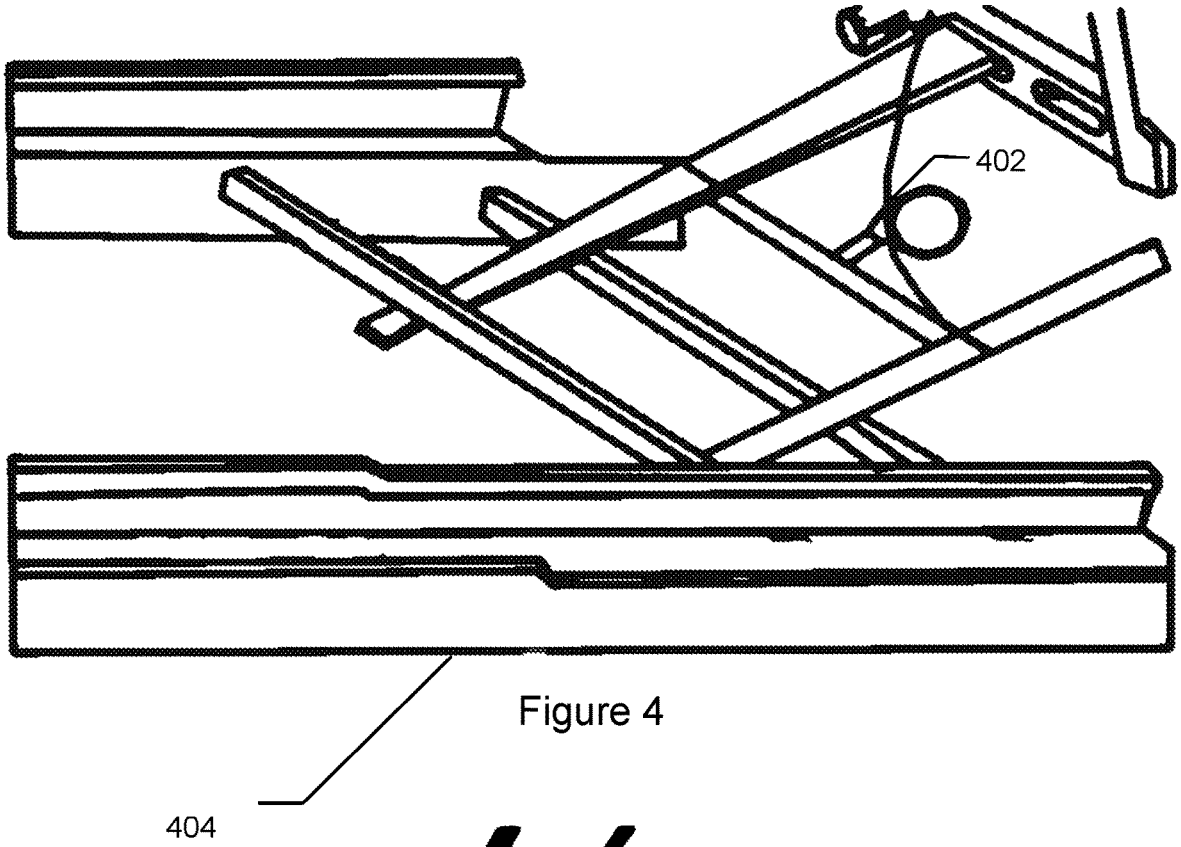
Figure 5:
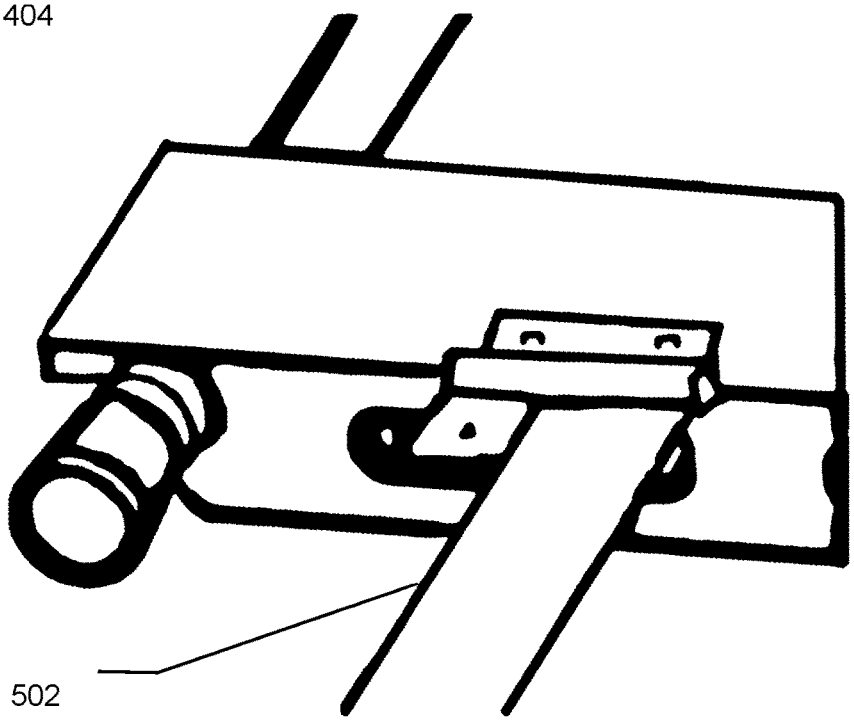
Figure 6:
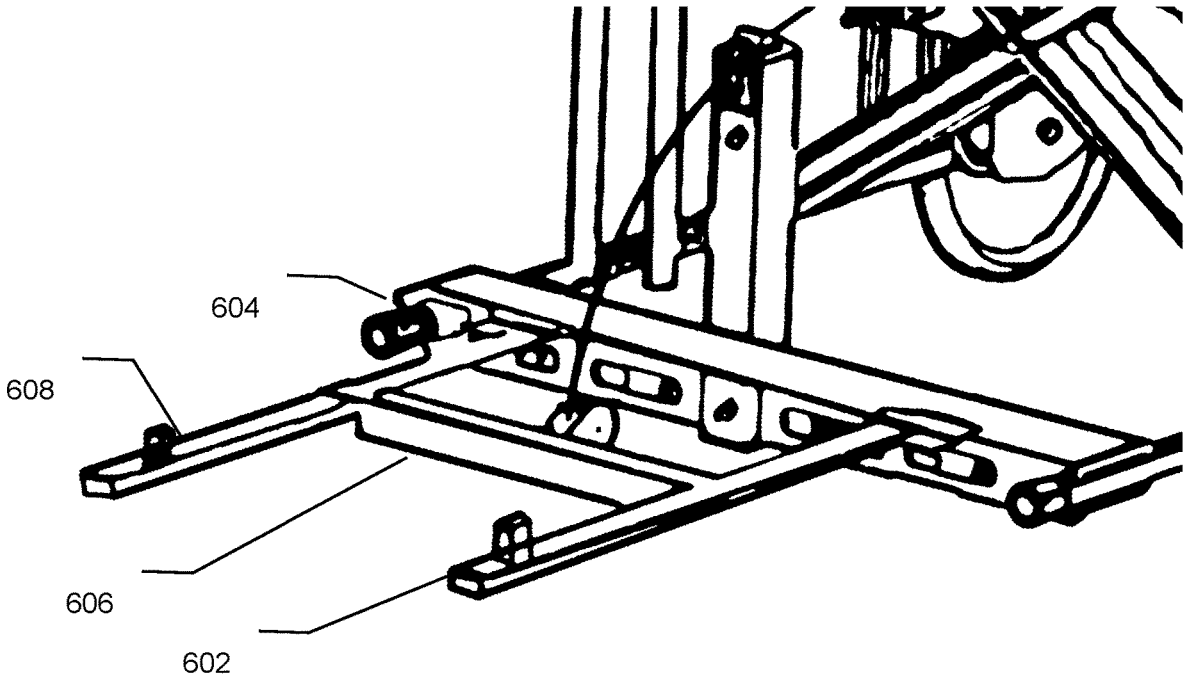
Figure 7:
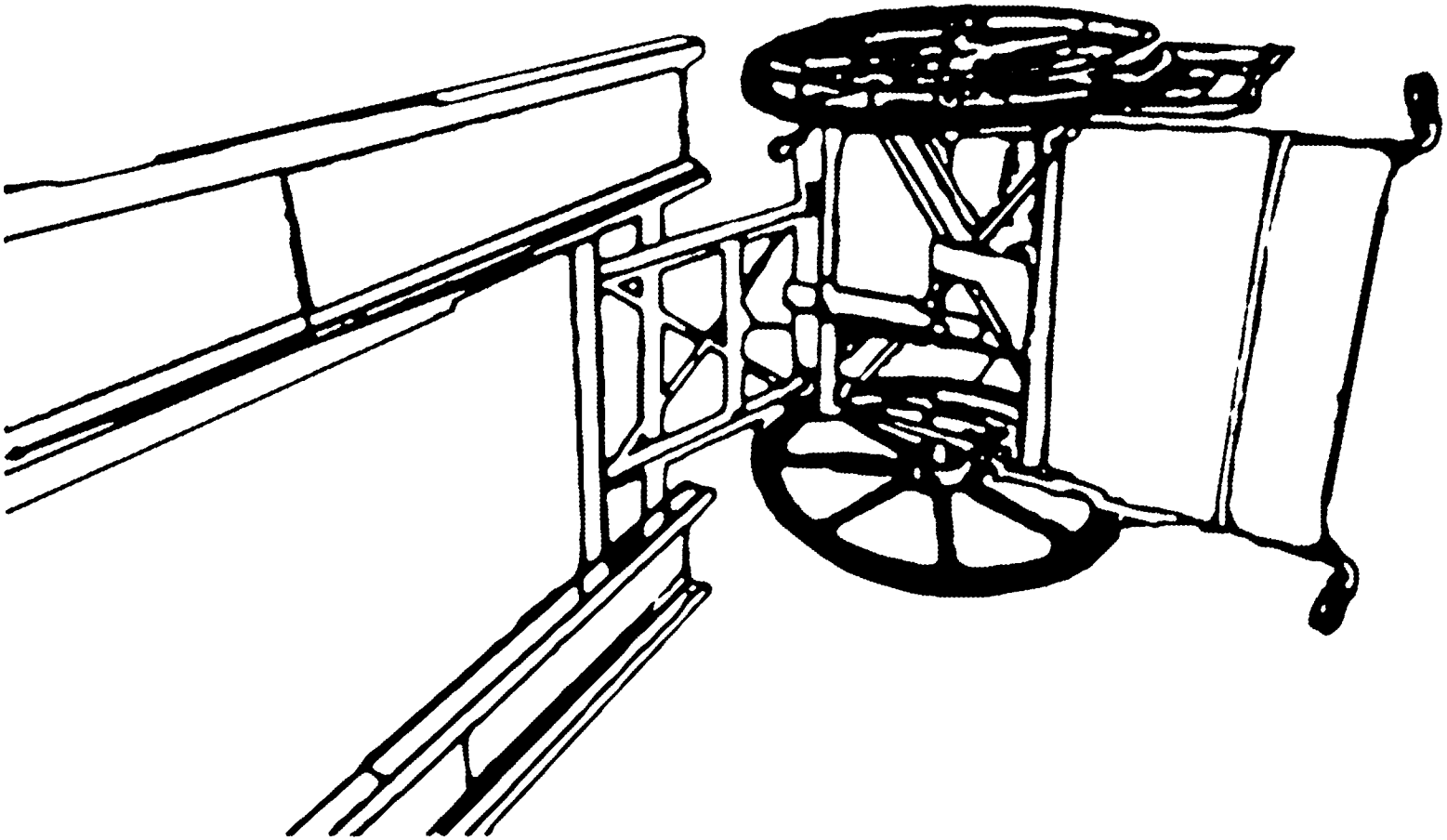

FIG. 4 shows a closeup of the model of the ramp, its sidewalls, and its traction-enhanced surface.

Electromechanical System

The Electromechanical System consists of a 24-V DC brushless motor 1808, microcontroller 1804, motor shield controller 1804, battery 1806, along with wiring and user interface buttons/controls. The motor 1002—along with the motor controller, pulley, battery, and microcontroller—are mounted with shaft-collars 1200 along the front-bottom portion of the wheelchair in order to better distribute the total weight of the device. Steel cable 404 is wound around the motor-pulley 1004 and functions to transfer torque from the motor to the RAM during ramp deployment and retrieval.

A latching/mechanical locking/safety mechanism may be provided to maintain the RAM in the upright position (not shown). For example, a solenoid driven bayonet or ball-pin mechanism may be used to lock the RAM in the stowed position. This addition must be easy for the user to interface with and it must not interfere with functionality. A camera/rearview alignment system is preferably provided for the stakeholder to utilize the system (not shown).

A mechanical stop 1602 may be present behind the backseat to further protect the wheelchair occupant from collision with the ramp.

The ramp may be provided with a wedge at each end of the ramp 1606, to ease the bump where the ramp contacts the ground. Safety straps may be added to the wheelchair, that will keep the ramp in the upright position when not in use (not shown). This avoids, for example, a need to run the motor with a constant torque, and thus continually drain the battery.

The ramp contact with the ground is designed to have as high of a coefficient of friction as possible, to avoid slipping.

The wheelchair itself may be modified to provide a wheel ratcheting system to make rolling up and down the ramp safer and easier, and maximize the battery efficiency to increase the use cycles per charge.

Overall, the system and components above are more than sufficient in meeting the below criteria:

Load Capacity: at least 500-lbs.

Height Capability: 1-ft Elevations at a grade comfortable for wheelchair users.

Time Capability: 1 min 30 sec.

Portability: Fold-Compatible.

Ease of Use: Only Two Controls.

The invention thus boasts a niche in the market of devices for disabled users. The prototype device is suitable for adult individuals who utilize a standard-frame manual wheelchair and desire a light, affordable product to help traverse and uneven surfaces, and scale heights as great as 1-foot comfortably. The dimensions may be changed to accommodate other circumstances.

The system provides a practical, safe alternative for wheelchair users to avoid performing risky maneuvers to go up and down curbs.

Figure 8:
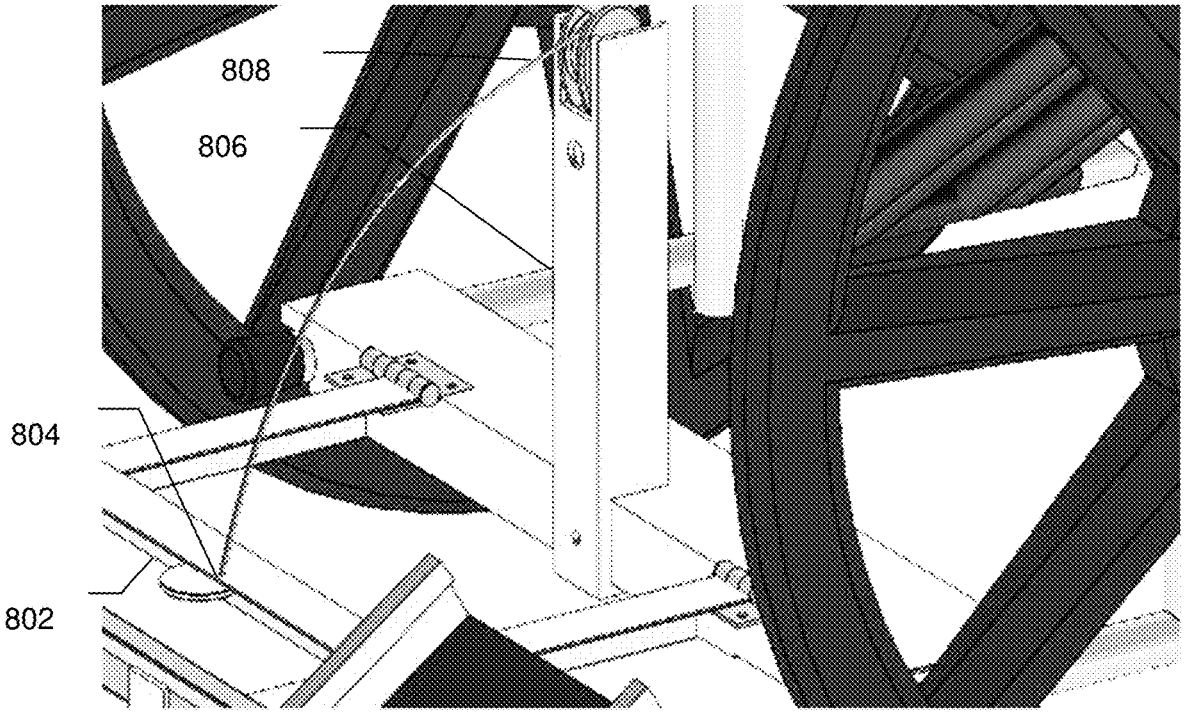
FIG. 8 shows a closeup of pulley-post with steel cable channeled through to pull RAM.

FIG. 8 shows a closeup of the pulley-post with steel cable channeled through to pull RAM.

Figure 9:
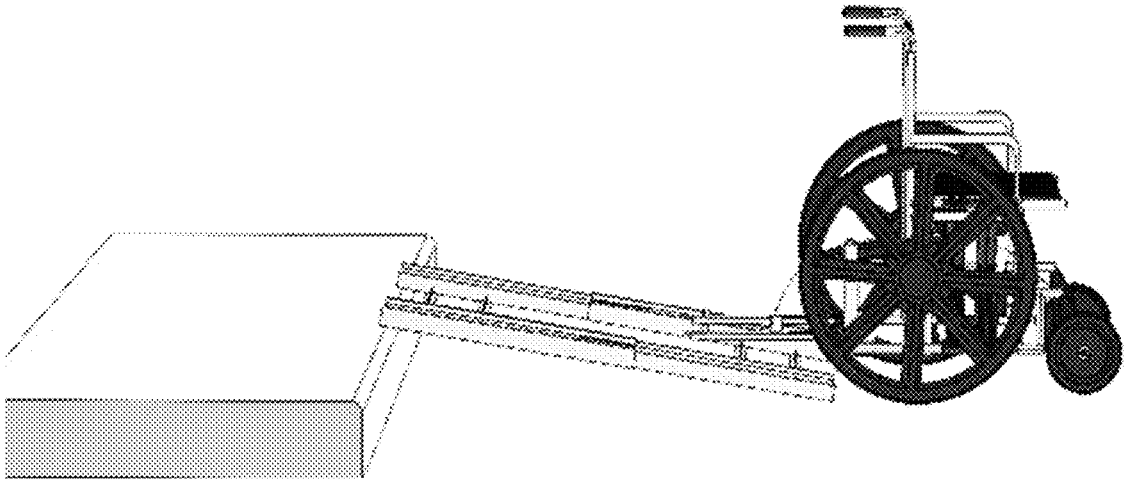
FIG. 9 shows a side view of ramp deployed and resting on top of a 7-inch curb.

FIG. 9 shows a side view of the ramp deployed and resting on top of 7-inch curb.

Figure 10A:
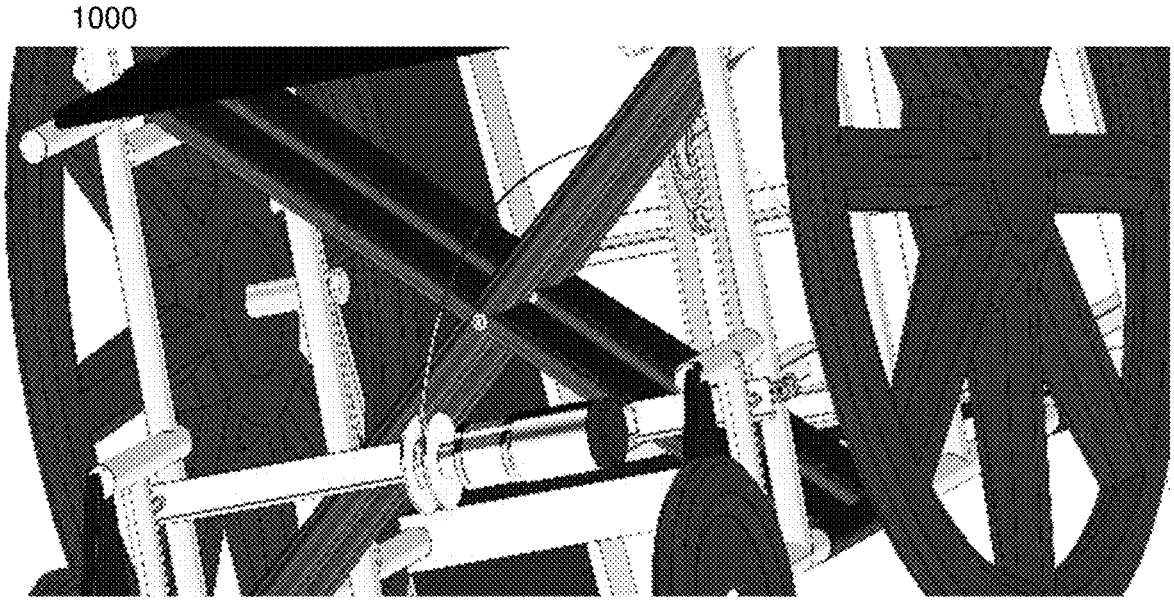
FIGS. 10A and 10B show closeup images of the motor, mount beam, and motor-pulley with steel cable wound in position.
Figure 10B:
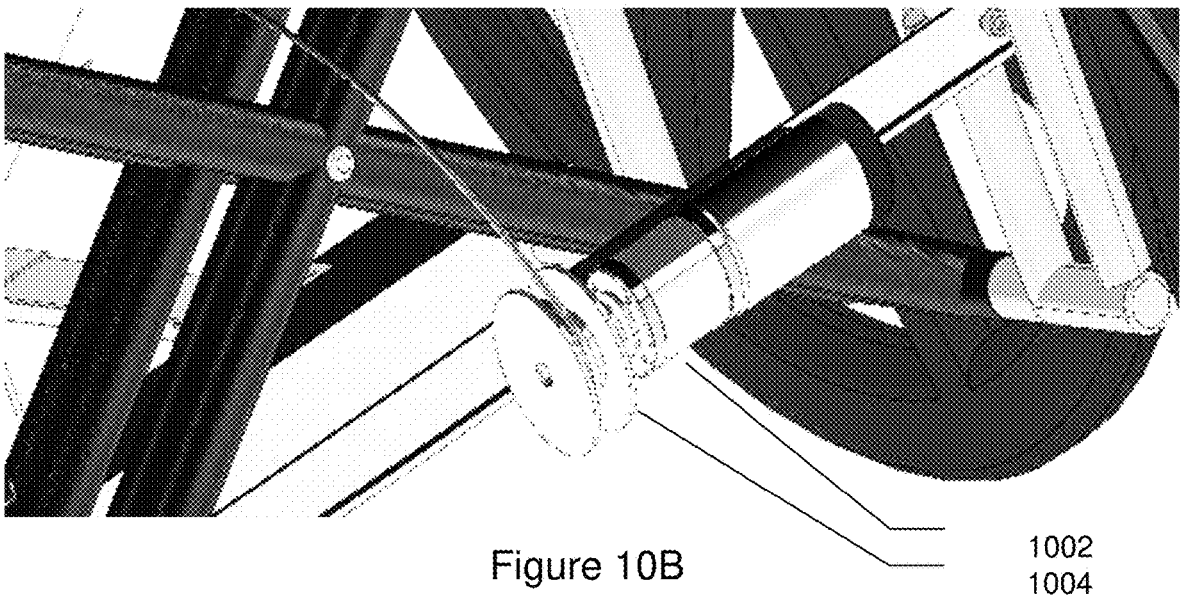

FIGS. 10A and 10B show closeup images of the motor, mount beam, and Motor-pulley with steel cable wound in position microcontroller, motor shield, and battery are not shown).

Figure 11:
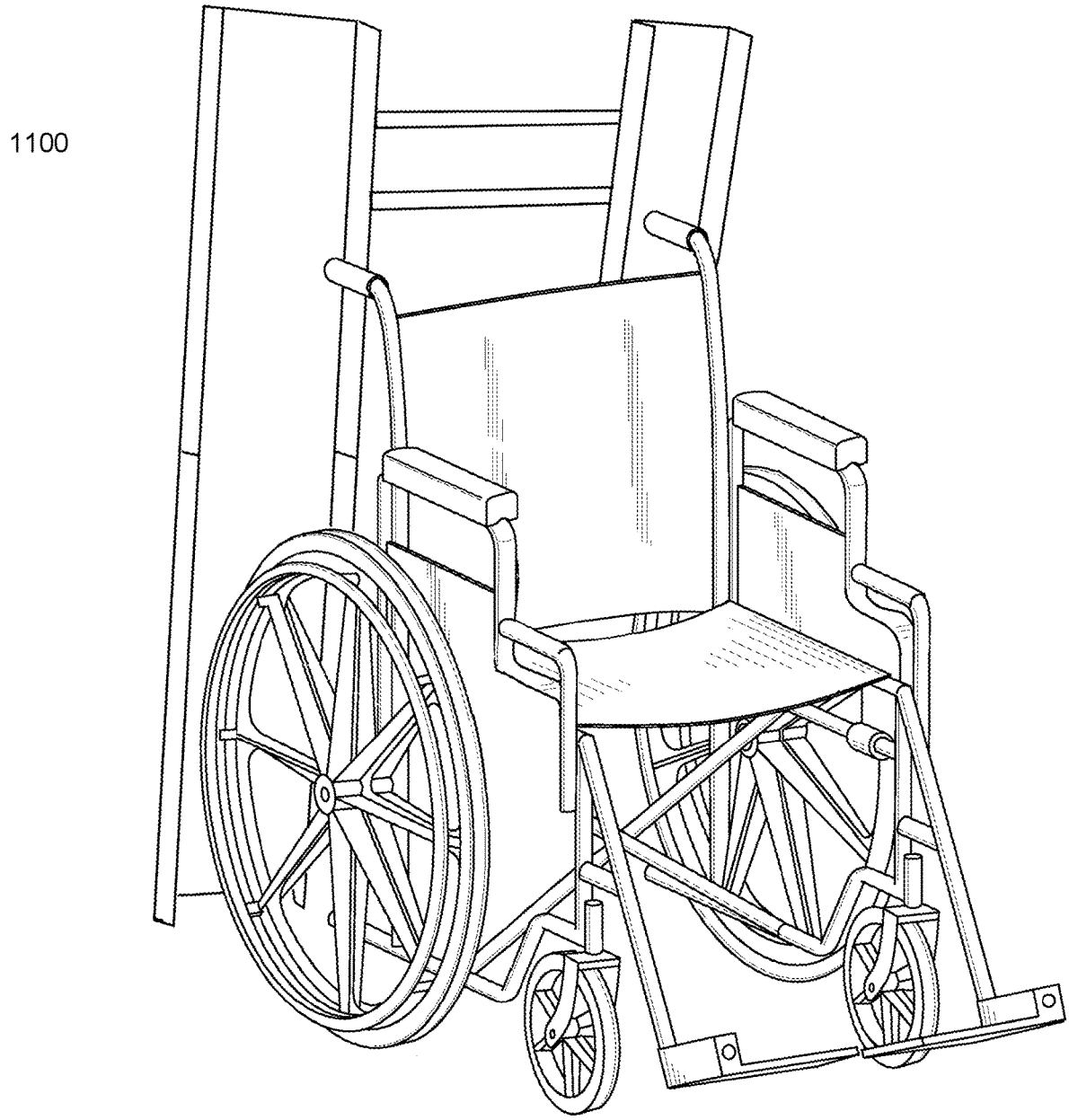
FIG. 11 shows a prototype device, with the ramp resting on rear of the wheelchair.

FIG. 11 shows a prototype device, ramp resting on rear of chair.

Figure 12:
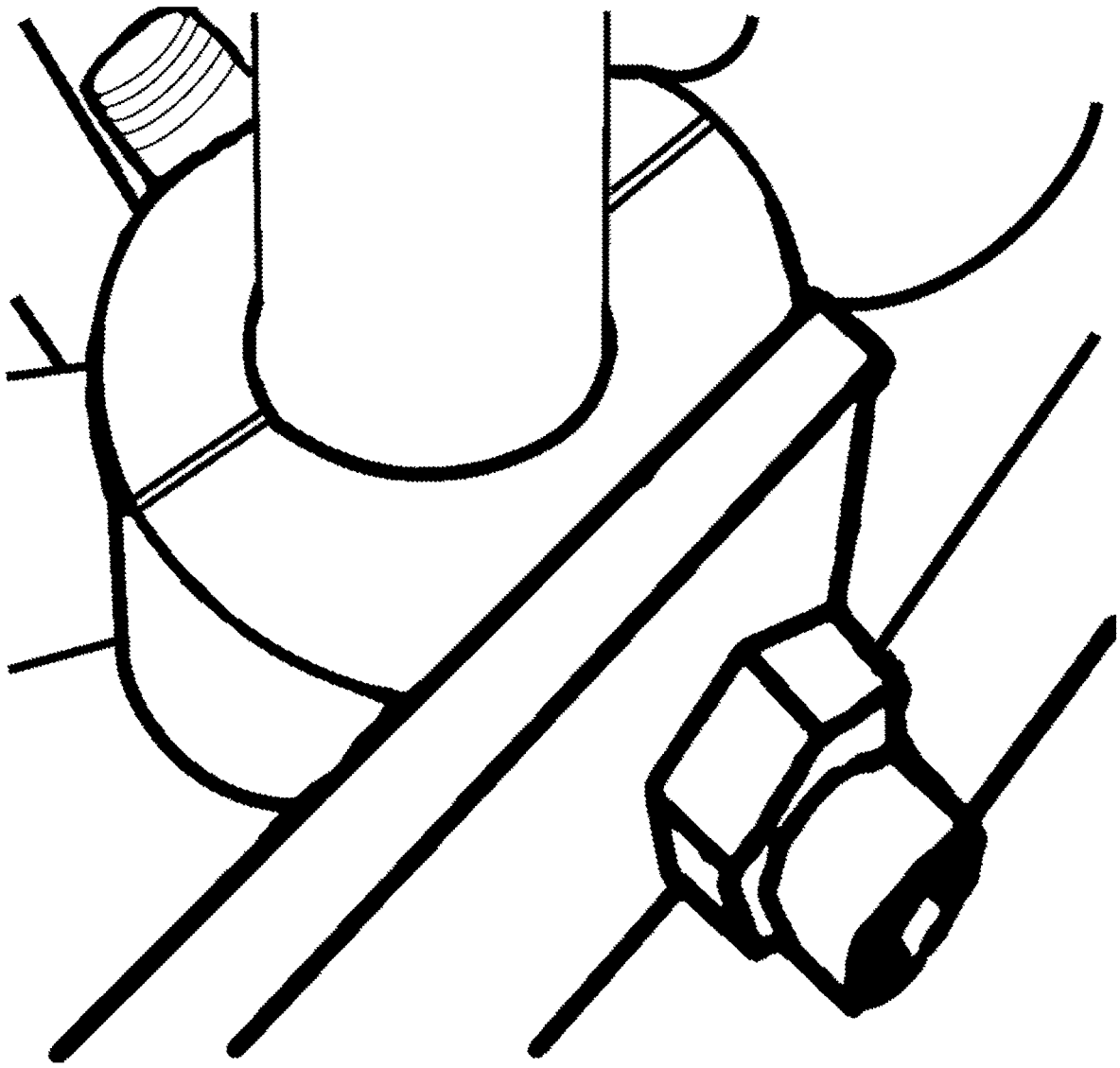
FIG. 12 shows a closeup image of the shaft-collar clamp.

FIG. 12 shows a closeup image of the shaft-collar clamp.

Figure 13:
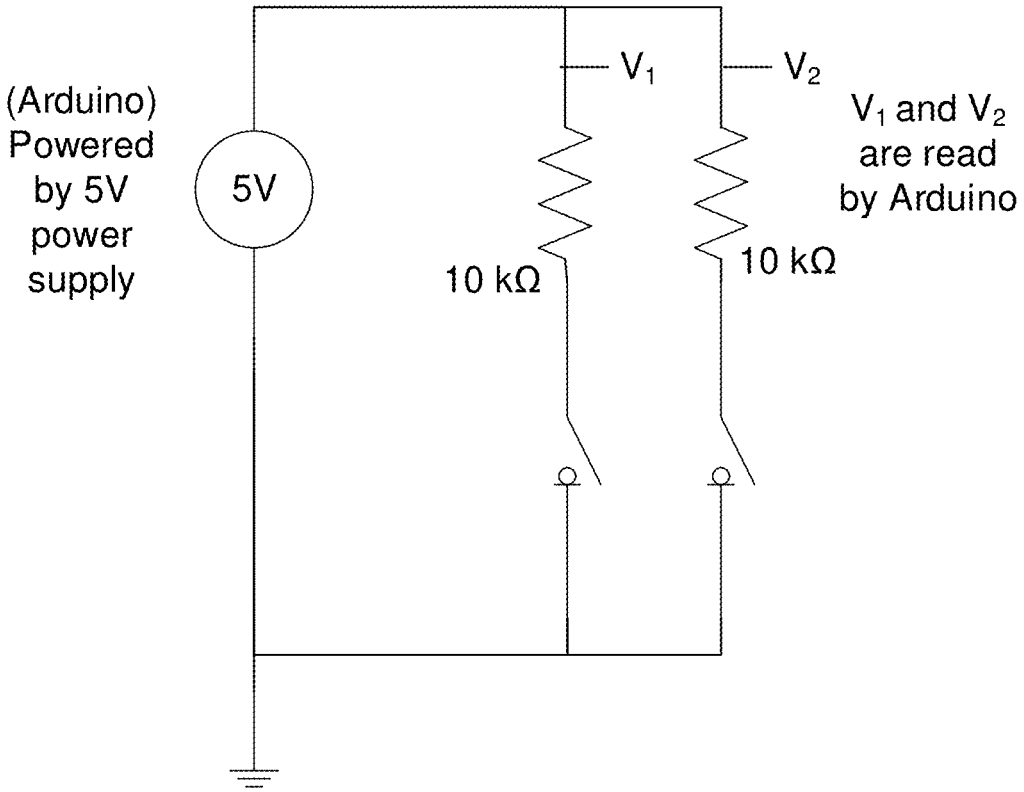
FIG. 13 shows a simplified circuit.

FIG. 13 shows a simplified circuit.

Figure 14:
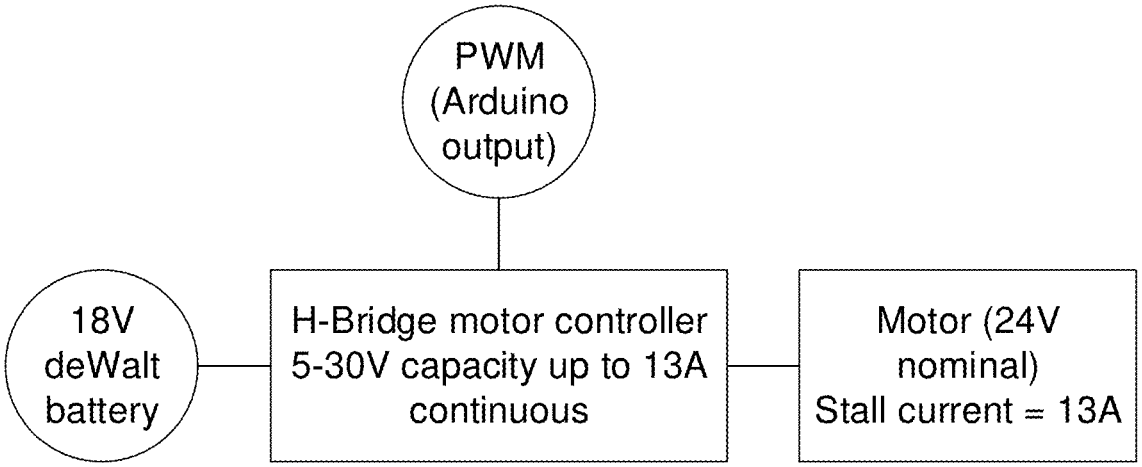
FIG. 14 shows a schematic of the motor control circuit.

FIG. 14 shows a schematic of the motor control circuit.

Figure 15A:
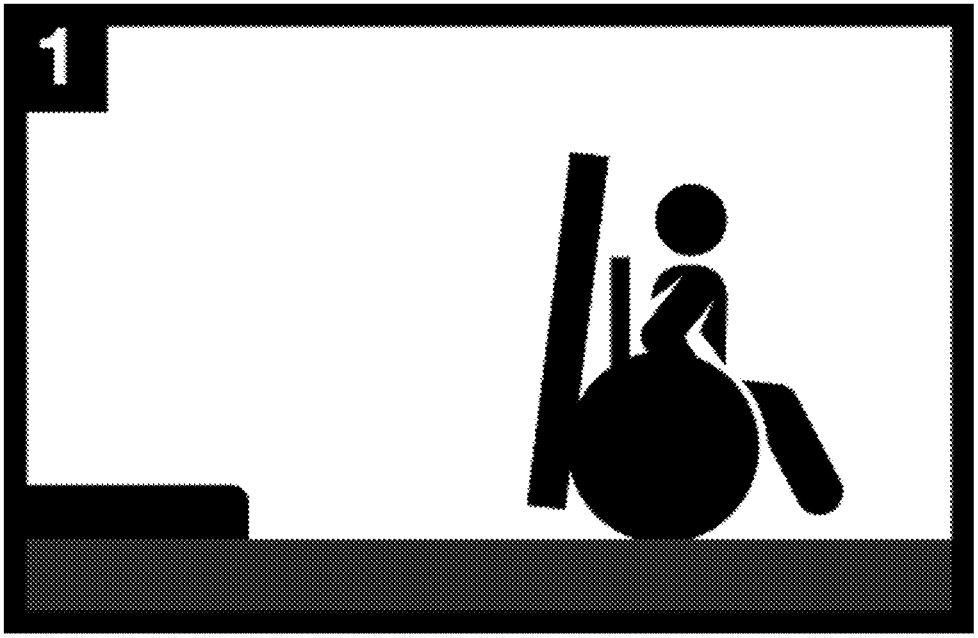
FIGS. 15A-15H show schematic drawings representing stages of a method according to the present invention.
Figure 15B:
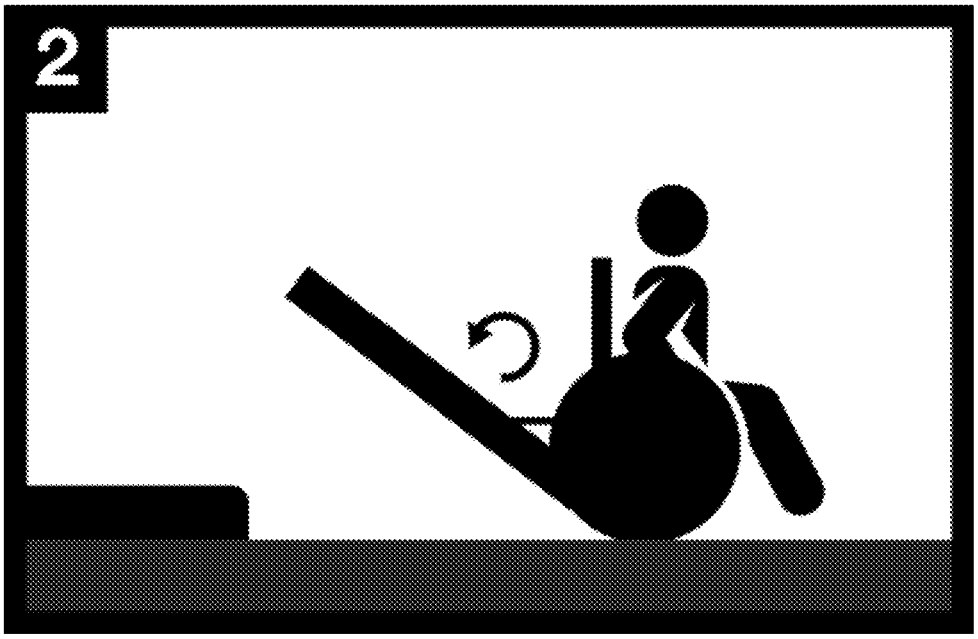
Figure 15C:
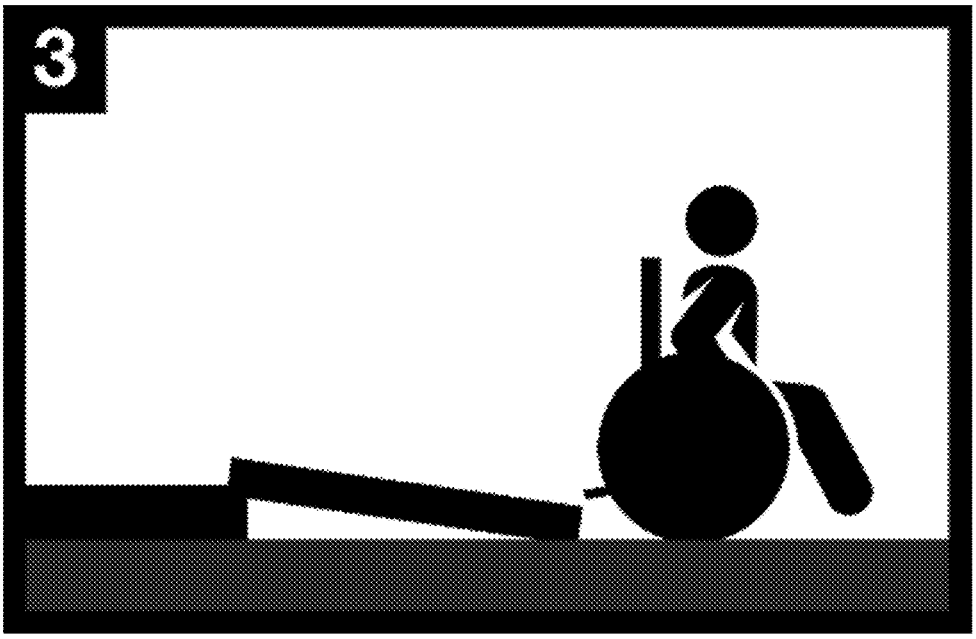
Figure 15D:
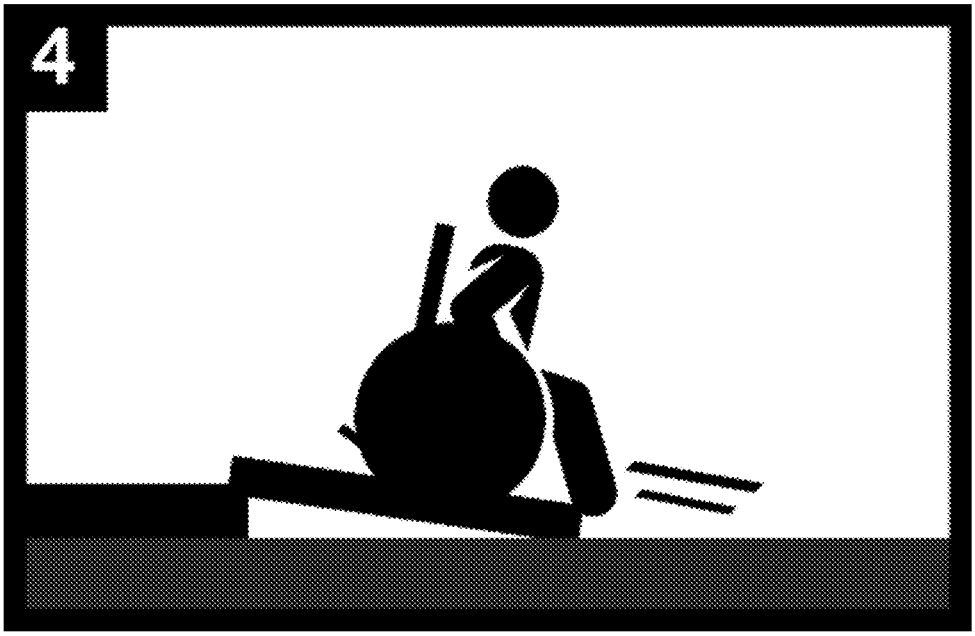
Figure 15E:
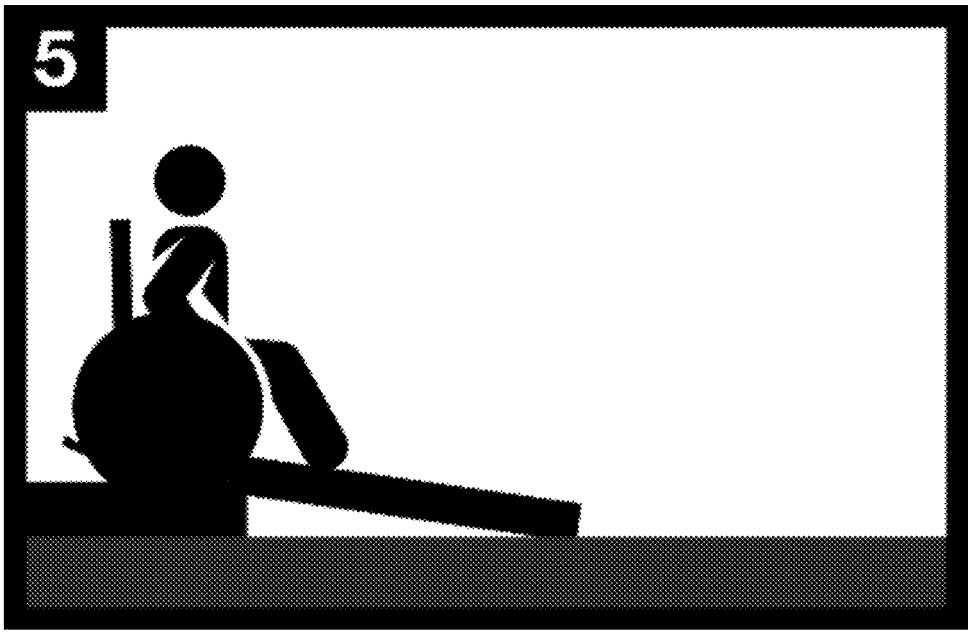
Figure 15F:
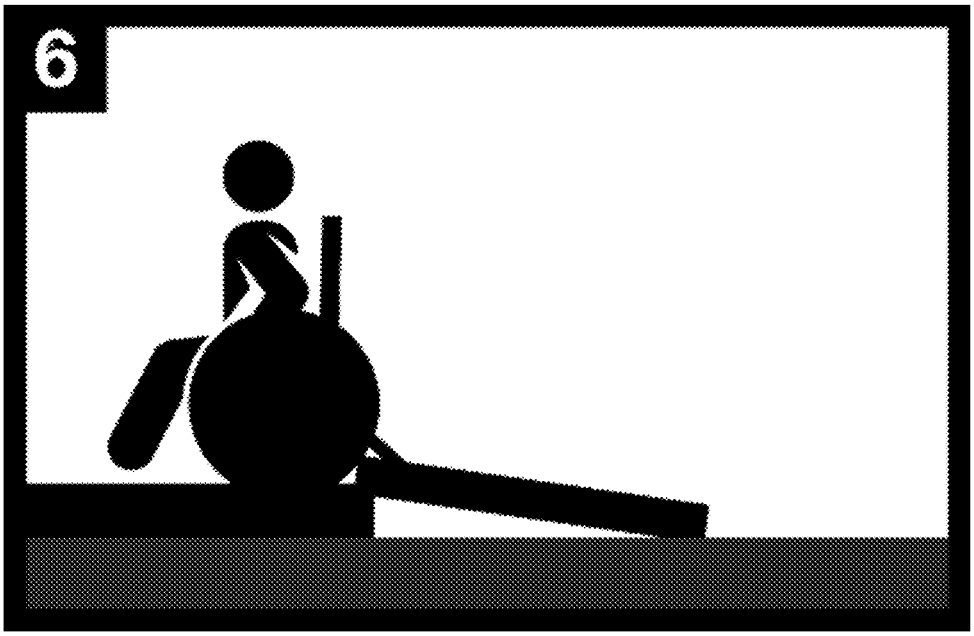
Figure 15G:
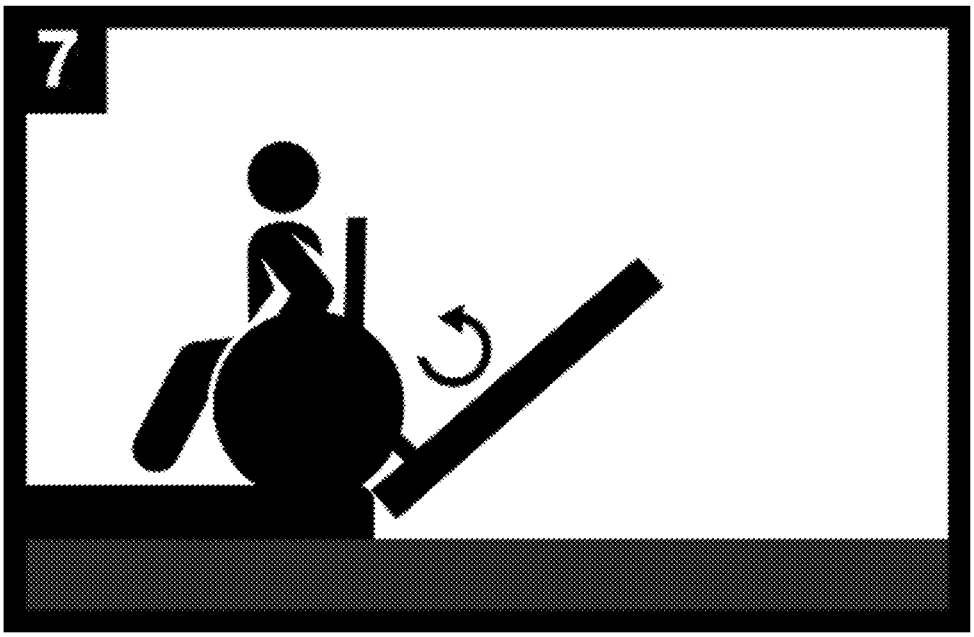
Figure 15H:
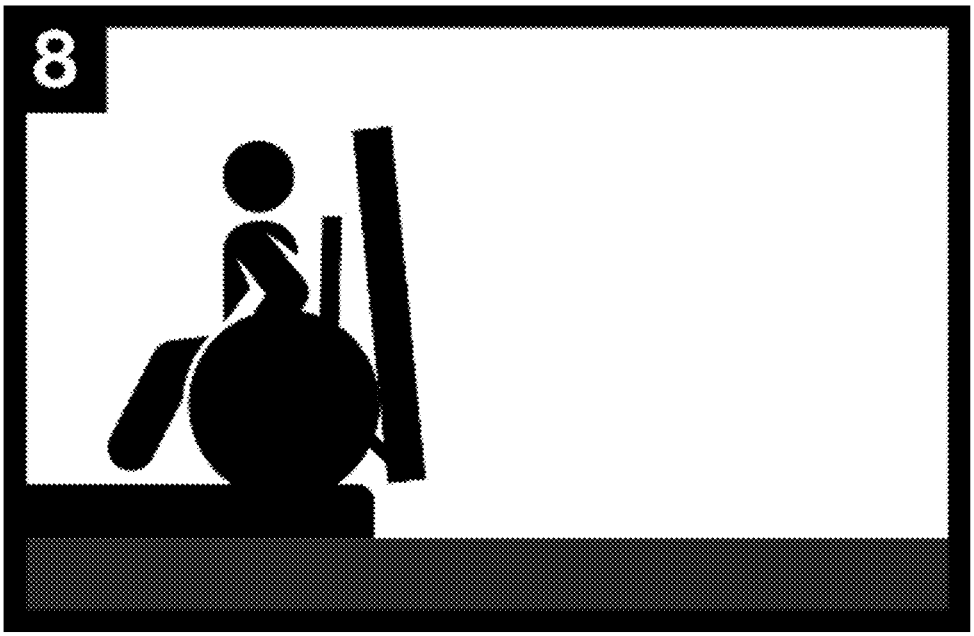

FIGS. 15A-15H represent stages of operation of the RAM. FIG. 15A represents the ramp held near vertically at the rear of a wheelchair, near a change in elevation (e.g., a curb). FIG. 15B represents the user controlling the RAM to lower the ramp to provide a smooth surface across the change in elevation. FIG. 15C represents the ramp in the fully lowered position, disengages from the RAM, and the user ready to back the chair across the ramp. FIG. 15D represents the user partially across the ramp. FIG. 15E represents the user fully across the ramp. FIG. 15F represents the user after turning the chair around, and in position to lift the ramp from its deployed position. FIG. 15G represents the user controlling the RAM to raise the ramp its stowed position. FIG. 15H represents the user ready to depart the change in elevation with the ramp in the near vertical position at the rear of the wheelchair.

Figure 16A:
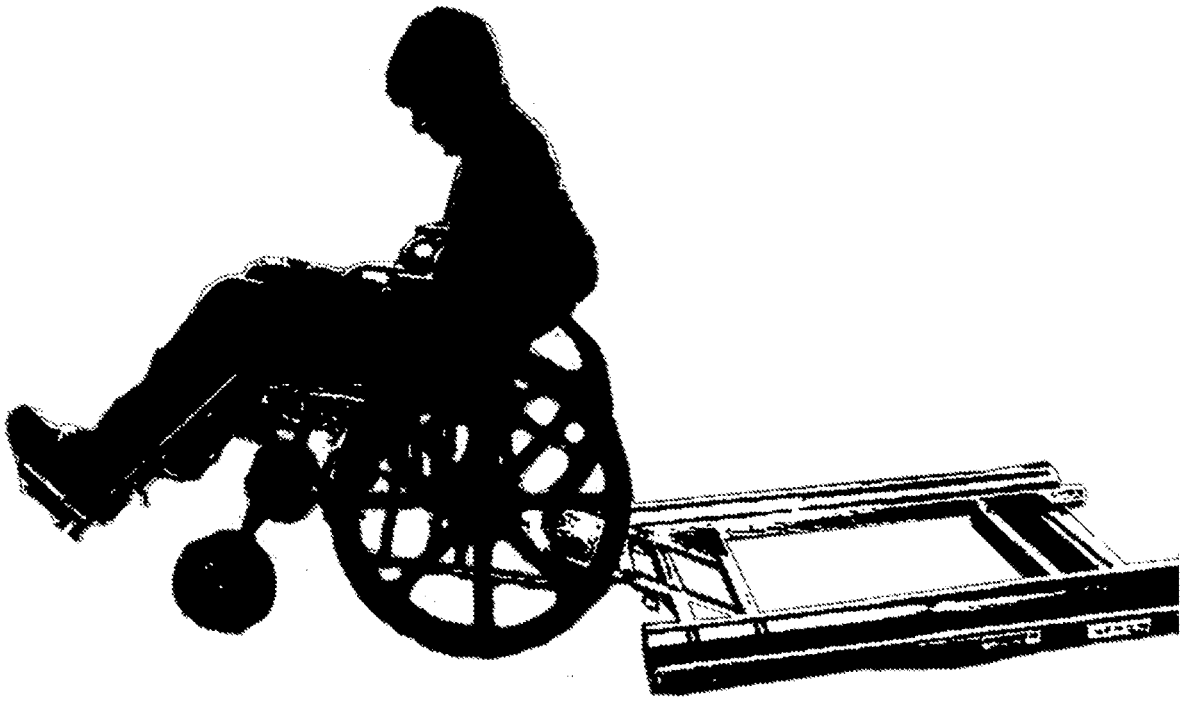
FIGS. 16A-16C show images of the ramp being raised by the RAM.
Figure 16B:
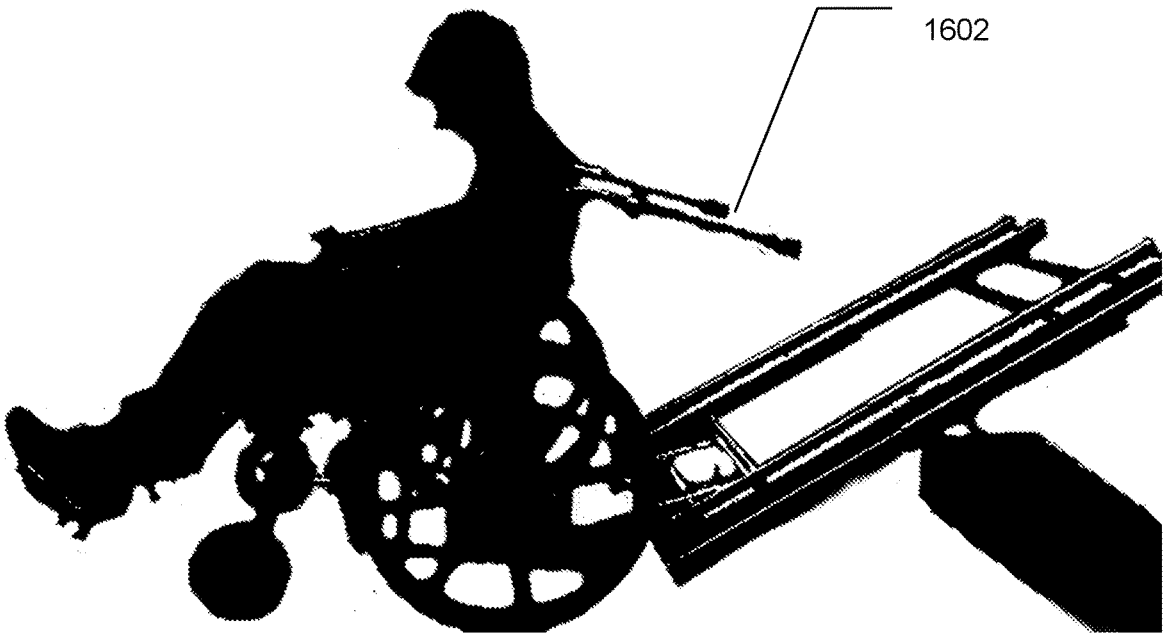
Figure 16C:
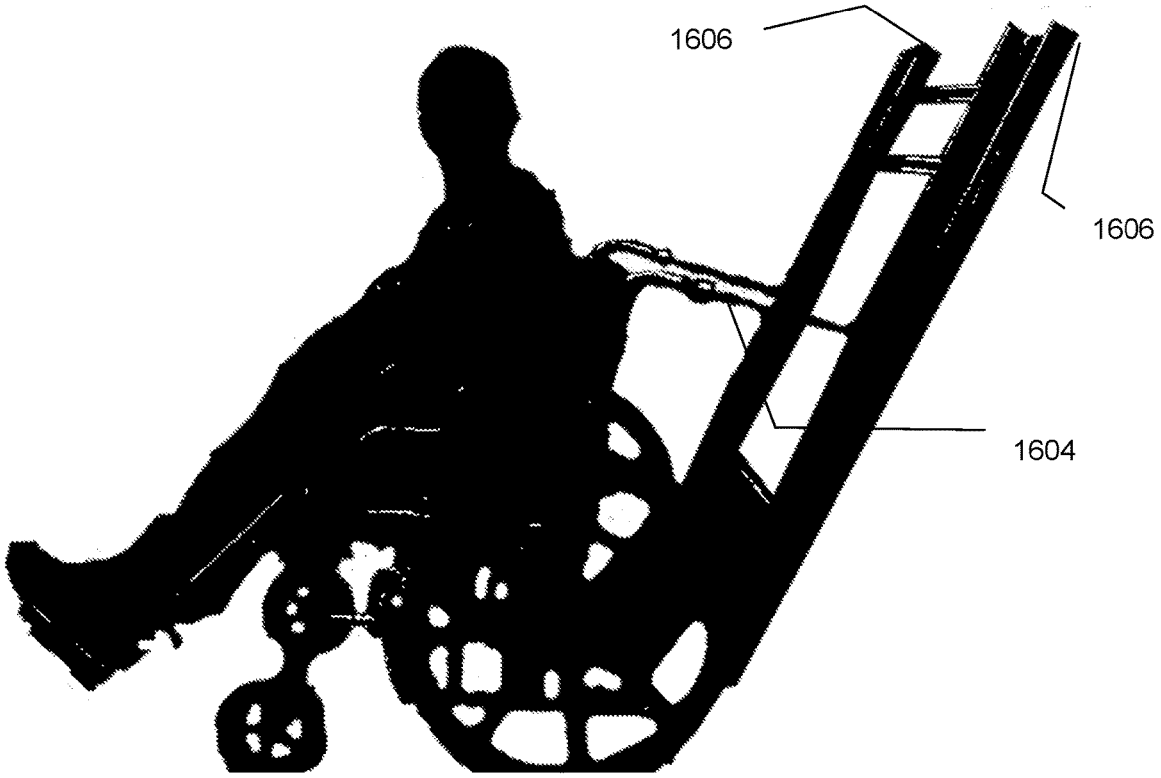

FIGS. 16A-16C show images of the ramp being raised by the RAM. FIG. 16A shows the user backing the wheelchair up to the ramp. FIG. 16B shows the RAM in mid position raising the ramp. FIG. 16C shows the ramp raised to the near vertical position.

Figure 17:
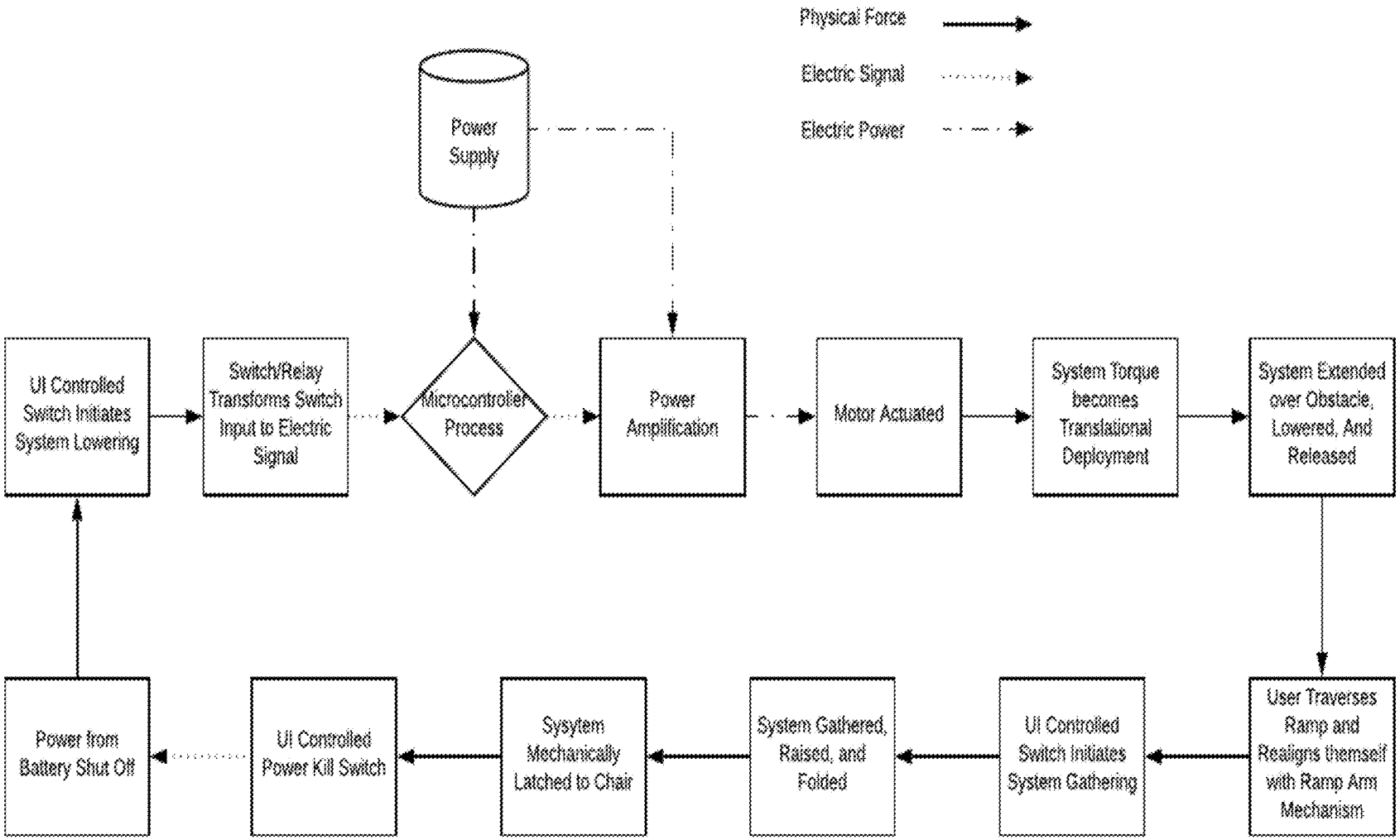
FIG. 17 shows a schematic drawing of the electronics.

FIG. 17 shows a schematic drawing of the electronics.

Figure 18:
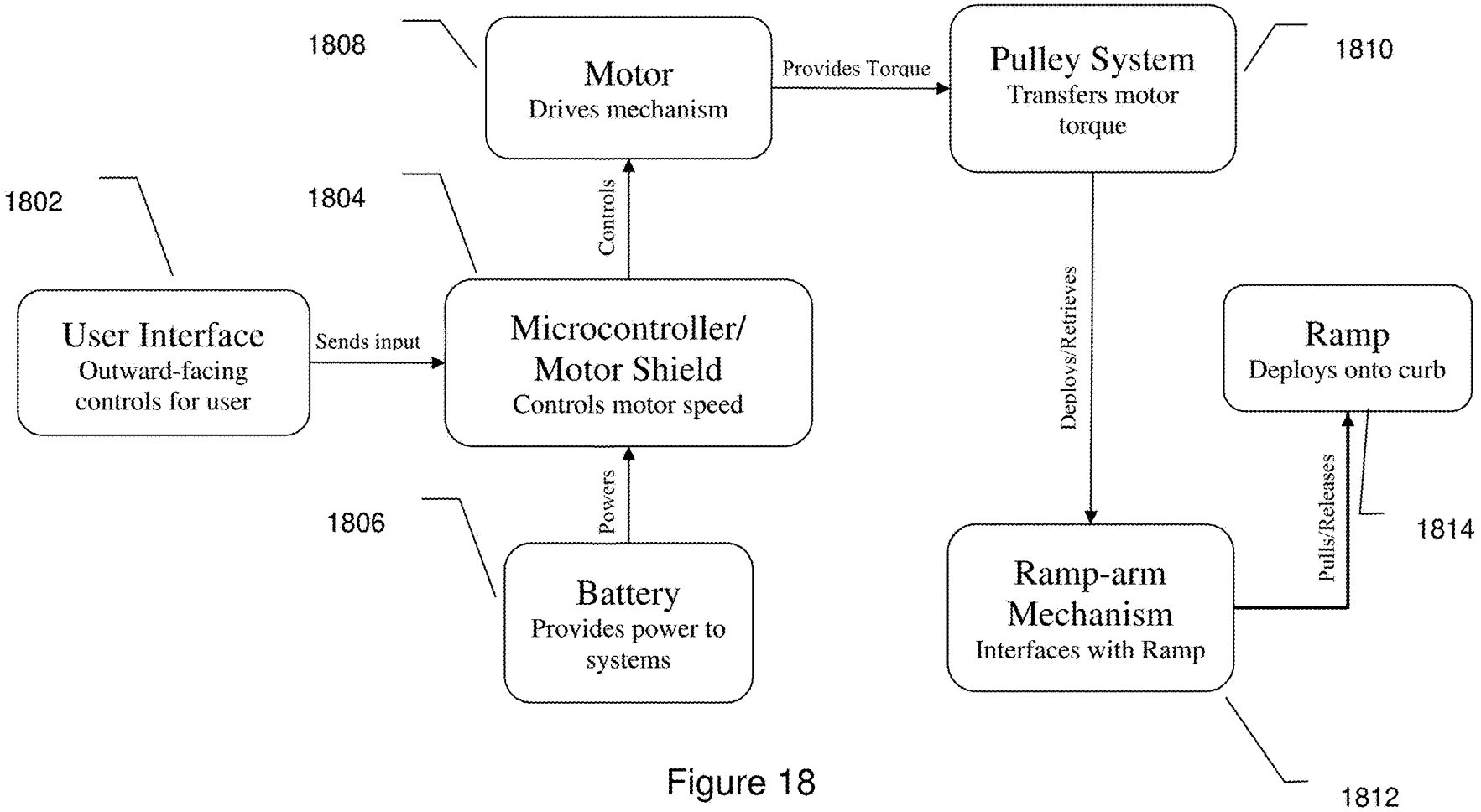
FIG. 18 shows a semi-schematic drawing of a system architecture.

FIG. 18 shows a semi-schematic drawing of a system architecture.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims and other features and acts that would be recognized by one skilled in the art are intended to be within the scope of the claims.

What is claimed is:

1. A wheelchair ramp system, comprising:

a ramp comprising:

a platform, configured to support wheels of a wheelchair for traversing the platform, having a first end and a second end, the platform having a sufficient stiffness to support a wheelchair and occupant load on the platform when supported at the first end and the second end;

a respective lifting mechanism interface in the platform disposed near each of the first end and the second end of the platform, each respective lifting mechanism interface being configured to support a cantilever lifting force on the platform;

a lifting element, configured to selectively engage and disengage each respective lifting mechanism interface in the platform disposed near each of the first end and the second end of the platform and to apply the cantilever lifting force about a pivot axis to transition the ramp between a first raised, stowed position configured to permit transport of the ramp with wheelchair, and a second lowered, deployed position, configured to permit traversal of the wheelchair across the platform;

a motor, configured to supply the cantilever lifting force to the lifting element to transition the ramp between the first raised, stowed position and the second lowered, deployed position; and a control, configured to drive the motor.

2. The wheelchair ramp system according to claim 1, further comprising the wheelchair, wherein:

the motor is disposed below a seat of the wheelchair; and the platform in the second raised, stowed position is located behind a seat back the wheelchair.

3. The wheelchair ramp system according to claim 1, wherein the platform is collapsible to accommodate folding of the wheelchair while the wheelchair ramp system is affixed behind a seat of the wheelchair.

4. The wheelchair ramp system according to claim 1, wherein the motor alone directly drives the lifting element.

5. The wheelchair ramp system according to claim 1, wherein the motor drives a mechanism comprising a cable and a pulley.

6. The wheelchair ramp system according to claim 1, wherein the motor drives a mechanism comprising a geartrain.

7. The wheelchair ramp system according to claim 1, further comprising a mechanical element configured to secure the platform in the first raised, stowed position.

8. The wheelchair ramp system according to claim 1, further comprising an electromechanical element configured to automatically secure the platform in the first raised, stowed position.

9. The wheelchair ramp system according to claim 1, further comprising a mechanical stop configured to prevent collision of the ramp with the rear of the wheelchair.

10. A method of permitting a wheelchair to traverse a sharp change in elevation, comprising:

providing a ramp having a platform configured to support wheels of the wheelchair for traversing the platform, the platform having a first end and a second end, the platform having sufficient stiffness to support a wheelchair and occupant load on the platform when supported at the first end and the second end, the ramp having a lifting mechanism interface disposed near each of the first end and the second end of the platform, each respective lifting mechanism interface being configured to support a cantilever lifting force on the platform to raise and lower the platform between a near horizontal orientation for traverse of the platform by the wheelchair, and a near vertical orientation configured to be stowed at the rear of the wheelchair, and each respective lifting mechanism interface being configured to selectively engage and disengage with a lifting mechanism;

actuating a motor to lower the platform at the rear of the wheelchair to the near horizontal orientation across the sharp change in elevation; and disengaging the lifting mechanism from the lifting mechanism interface, to thereby permit the wheelchair to freely traverse the ramp.

11. The method according to claim 10, further comprising:

after traversing the ramp, reengaging the lifting mechanism with the lifting mechanism interface; and after reengaging the lifting mechanism with the lifting mechanism interface, raising the ramp at the rear of the wheelchair from the near horizontal orientation to the near vertical orientation.

12. The method according to claim 11, further comprising after raising the ramp, latching the ramp at the rear of the wheelchair in the near vertical orientation.

13. The method according to claim 12, further comprising after latching the ramp, maintaining the ramp in the near vertical orientation with an electronically controlled latch; and automatically unlatching the ramp before lowering the ramp.

14. The method according to claim 10, further comprising driving the lifting mechanism with a motor configured to supply sufficient force on the lifting element to raise and lower the ramp.

15. The method according to claim 14, further comprising controlling the motor with a microprocessor.

16. The method according to claim 14, further comprising driving a mechanism comprising a cable and a pulley with the motor.

17. The method according to claim 14, further comprising driving a mechanism comprising a geartrain with the motor.

18. The method according to claim 10, further comprising maintaining the ramp in the near vertical orientation with a latch, and unlatching the ramp before lowering the ramp.

19. The method according to claim 10, further comprising maintaining a distance between the ramp and the rear of the wheelchair with a mechanical stop.

20. A wheelchair, comprising:

a seat, supported by a frame on a set of wheels;

a selectively deployable platform, having a sufficient stiffness to support the wheelchair and occupant load on the selectively deployable platform at the first end and second end of the selectively deployable platform; and a pair of lifting mechanism interfaces in the selectively deployable platform respectively disposed near each opposite end of the selectively deployable platform, configured to apply cantilever lifting forces about a pivot axis to the selectively deployable platform;

a lifting mechanism, configured to selectively engage and disengage each of the lifting mechanism interfaces and to apply a force to raise the selectively deployable platform between a first raised, stowed position and to lower the selectively deployable platform to a second lowered, deployed position suitable for traversal of the wheelchair across the selectively deployable platform over a gap; and an automated control, configured to supply power to the lift for raising and lowering the selectively deployable platform.

* * * * *